US009887053B2

(12) United States Patent
Zulim et al.

(10) Patent No.: US 9,887,053 B2
(45) Date of Patent: Feb. 6, 2018

(54) CONTROLLING RELAY ACTUATION USING LOAD CURRENT

(71) Applicant: ABL IP Holding LLC, Conyers, GA (US)

(72) Inventors: Dalibor Zulim, Conyers, GA (US); Richard L. Westrick, Jr., Social Circle, GA (US); Leslie Wayne Mullins, Madison, GA (US)

(73) Assignee: ABL IP Holding LLC, Atlanta, GA (US)

( * ) Notice: Subject to any disclaimer, the term of this patent is extended or adjusted under 35 U.S.C. 154(b) by 231 days.

(21) Appl. No.: 14/812,393

(22) Filed: Jul. 29, 2015

(65) Prior Publication Data

US 2016/0035524 A1 Feb. 4, 2016

Related U.S. Application Data

(60) Provisional application No. 62/030,485, filed on Jul. 29, 2014.

(51) Int. Cl.
*H01H 47/22* (2006.01)
*H01H 47/32* (2006.01)

(52) U.S. Cl.
CPC ..... *H01H 47/223* (2013.01); *H01H 47/325* (2013.01)

(58) Field of Classification Search
CPC ..... H01H 47/223; H01H 47/325; H01H 47/22
See application file for complete search history.

(56) References Cited

U.S. PATENT DOCUMENTS 3,728,554 A 4/1973 Kuhn et al.
4,229,669 A 10/1980 Smith
(Continued)

FOREIGN PATENT DOCUMENTS

EP 0809922 12/1997
EP 0997921 5/2000
(Continued)

OTHER PUBLICATIONS

"Temperature Considerations for DC Relays," Application Note, Tyco Electronics Corporation—P&B, Document. Available at: <http://relays.te.com/appnotes/app_pdfs/13c3226.pdf>, 2 pages.

*Primary Examiner* — Zeev V Kitov
(74) *Attorney, Agent, or Firm* — Kilpatrick Townsend & Stockton, LLP

(57) ABSTRACT

In some aspects, a relay control device includes a processor and a timer. The processor is electrically connectable to a relay that controls current flow to a load device. The processor causes the relay to be actuated at a first point in time so that a current flows to the load device. The processor determines an actuation duration for the relay from a measurement of the load current that is obtained with a current sense component. The processor determines a frequency of an input voltage or current from the measured load current. The processor synchronizes the timer with this frequency and identifies a zero-crossing point for a second load current based on the synchronized timer. The processor subsequently causes the relay to be actuated at a time that is offset from the zero-crossing point by the actuation duration.

20 Claims, 15 Drawing Sheets

(56) References Cited

U.S. PATENT DOCUMENTS

| | | | |
|---|---|---|---|
| 4,445,183 | A | 4/1984 | Mccollum et al. |
| 4,704,652 | A | 11/1987 | Billings |
| 4,745,511 | A | 5/1988 | Kugelman et al. |
| 4,745,515 | A | 5/1988 | Fowler |
| 4,760,483 | A | 7/1988 | Kugelman et al. |
| 4,918,293 | A | 4/1990 | McGeorge |
| 5,055,962 | A | 10/1991 | Peterson et al. |
| 5,218,509 | A | 6/1993 | Fowler et al. |
| 5,239,209 | A | 8/1993 | Hockman et al. |
| 5,264,761 | A | 11/1993 | Johnson et al. |
| 5,267,120 | A | 11/1993 | Graff et al. |
| 5,347,420 | A | 9/1994 | Fowler |
| 5,452,176 | A | 9/1995 | Fowler |
| 5,640,143 | A | 6/1997 | Myron et al. |
| 5,790,354 | A | 8/1998 | Altiti et al. |
| 5,838,077 | A | 11/1998 | Chelcun et al. |
| 5,930,104 | A | 7/1999 | Kadah et al. |
| 6,226,167 | B1 | 5/2001 | Chmiel |
| 6,233,132 | B1 | 5/2001 | Jenski |
| 6,621,270 | B2 | 9/2003 | Johnson et al. |
| 6,621,668 | B1 | 9/2003 | Sare |
| 6,643,112 | B1 | 11/2003 | Carton et al. |
| 6,756,771 | B1 | 6/2004 | Ball et al. |
| 6,903,554 | B2 | 6/2005 | Wilson et al. |
| 7,212,090 | B2 | 5/2007 | Kadah |
| 7,394,204 | B1 | 7/2008 | Shet et al. |
| 7,463,036 | B2 | 12/2008 | Finney et al. |
| 7,573,360 | B2 | 8/2009 | Bryan et al. |
| 7,660,083 | B2 | 2/2010 | Yao et al. |
| 7,746,620 | B2 | 6/2010 | Bedingfield |
| 7,782,590 | B2 | 8/2010 | Bedingfield et al. |
| 8,154,841 | B2 | 4/2012 | Allen et al. |
| 8,482,885 | B2 | 7/2013 | Billingsley et al. |
| 8,520,349 | B2 | 8/2013 | Billingsley et al. |
| 8,559,154 | B2 | 10/2013 | Li et al. |
| 8,614,866 | B2 | 12/2013 | Billingsley et al. |
| 9,064,661 | B2 | 6/2015 | Westrick, Jr. et al. |
| 2003/0218847 | A1 | 11/2003 | Lesesky et al. |
| 2004/0169987 | A1 | 9/2004 | Green |
| 2006/0157452 | A1* | 7/2006 | Karakas ..... B23K 11/256 219/110 |
| 2006/0164778 | A1 | 7/2006 | Beletsky et al. |
| 2007/0108845 | A1 | 5/2007 | Crane |
| 2008/0013227 | A1 | 1/2008 | Mernyk et al. |
| 2009/0027824 | A1 | 1/2009 | Allen et al. |
| 2009/0105415 | A1 | 4/2009 | Liu et al. |
| 2009/0213519 | A1 | 8/2009 | Bedingfield |
| 2009/0213520 | A1 | 8/2009 | Bedingfield et al. |
| 2010/0118451 | A1* | 5/2010 | Scott ..... H02H 1/0015 361/47 |
| 2011/0170223 | A1* | 7/2011 | DiMarco ..... H02H 3/08 361/94 |
| 2011/0228438 | A1 | 9/2011 | Kohri et al. |
| 2013/0033625 | A1 | 2/2013 | Kato |
| 2013/0211615 | A1 | 8/2013 | Zikes et al. |
| 2013/0241527 | A1 | 9/2013 | Russell et al. |
| 2013/0334201 | A1 | 12/2013 | Nicholson |
| 2013/0342950 | A1 | 12/2013 | Westrick, Jr. et al. |

FOREIGN PATENT DOCUMENTS

| | | |
|---|---|---|
| EP | 2156546 | 2/2010 |
| EP | 2469554 | 6/2012 |
| EP | 2482085 | 8/2012 |
| EP | 2469554 | 10/2012 |
| EP | 2555004 | 5/2013 |
| FR | 2346883 | 10/1977 |
| WO | 199519659 | 7/1995 |
| WO | 199625021 | 8/1996 |
| WO | 2002082485 | 10/2002 |
| WO | 2007068042 | 6/2007 |
| WO | 2008148160 | 12/2008 |
| WO | 2013033625 | 3/2013 |
| WO | 2013153459 | 10/2013 |
| WO | 2013191777 | 12/2013 |

* cited by examiner

CONTROLLING RELAY ACTUATION USING LOAD CURRENT

CROSS-REFERENCE TO RELATED APPLICATIONS

This disclosure claims priority to U.S. Provisional Application Ser. No. 62/030,485 filed Jul. 29, 2014 and titled "Multi-Function Current Sense Device," the contents of which are hereby incorporated by reference.

FIELD OF THE INVENTION

This disclosure relates to monitoring and controlling electrical systems and more particularly relates to electrical equipment in which measurements of a load current are used to control actuation of a relay.

BACKGROUND

Electrical systems can include devices for switching electric power. For example, an electromechanical relay can include one or more contacts for switching power from a power source to a load device. An armature of a relay can be moved between a first position that prevents current flow between the power source and the load and a second position that allows current flow between the power source and the load. For instance, in the first position, the relay may provide an open circuit between the power source and the load and, in the second position, the relay may provide a closed circuit between the power source and the load.

In these electrical systems, one or more devices may be used to detect the duration of the movement of an armature of a relay. Detecting the actuation duration of the relay can allow the operational lifespan of the relay to be increased. For example, the actuation duration can be used for switching power to a load at a point at which a sinusoidal input voltage or current from a power source has a zero value ("a zero-crossing"). Setting a relay to a closed position at or near a point in time associated with the zero-crossing of the input line voltage can significantly reduce or completely eliminate an inrush current to a capacitive reactive load.

Prior solutions for monitoring relays involve utilizing a voltage detector to detect a zero-voltage cross and a relay actuation (i.e., contact closure) delay time. These prior solutions may be used to identify a contact closure that is referenced to a zero-crossing of a current or voltage waveform.

These prior solutions may present disadvantages. One disadvantage is that using a voltage detector to detect a zero-cross may not account for current that could be leading or lagging the voltage, which may cause an adverse effect on the expected lifetime of the relay. For example, the waveform (and zero-crossing point) of an AC input voltage waveform may differ from the waveform (and zero-crossing point) of a current through a load. This difference may lead to inaccuracies in determining a zero-crossing point for the load current.

Another disadvantage of prior solutions is that using a separate voltage detector requires additional components that decrease overall reliability and increase the overall cost of an electrical device. For example, an electrical device may use a voltage-specific (e.g., 120 Vac or 277 Vac) detection method or device to detect a line voltage's zero-cross point and to synchronize a relay switching algorithm with the zero-cross point of the line voltage. The electrical device may use a separate current sense device to measure the load current through the load. The electrical device may also use separate contact sense circuitry to measure relay actuation delay time. Using these different sets of sensing circuitry can significantly increase the complexity of the electrical device's design and decrease the overall reliability of the electrical device.

Accordingly, improved systems and methods are desirable for determining the actuation duration of a relay and performing other functions that involve monitoring relay current.

SUMMARY

Aspects of the present invention involve using measurements of a load current that are obtained with a current sense component to control actuation of a relay. Actuating a relay can include changing the state of the relay from an "ON" state to an "OFF" state, or vice versa. In some aspects, a relay control device includes a processor and a timer. The processor is electrically connectable to a relay that controls current flow to a load device. The processor causes the relay to be actuated at a first point in time so that a current flows to the load device. The processor determines an actuation duration for the relay from a measurement of the load current that is obtained with the current sense component. Examples of the current sense component include (but are not limited to) a current sense transformer, a current sense resistor, a Hall effect sensor, a current sense toroid. The processor determines a frequency of an input voltage or current from the measured load current. The processor synchronizes the timer with this frequency and identifies a zero-crossing point for a second load current based on the synchronized timer. The processor subsequently causes the relay to be actuated so that the second load current flows to the load device at a time that is offset from the zero-crossing point by the actuation duration.

These and other aspects, features and advantages of the present invention may be more clearly understood and appreciated from a review of the following detailed description and by reference to the appended drawings and claims.

DETAILED DESCRIPTION

Figure 1:
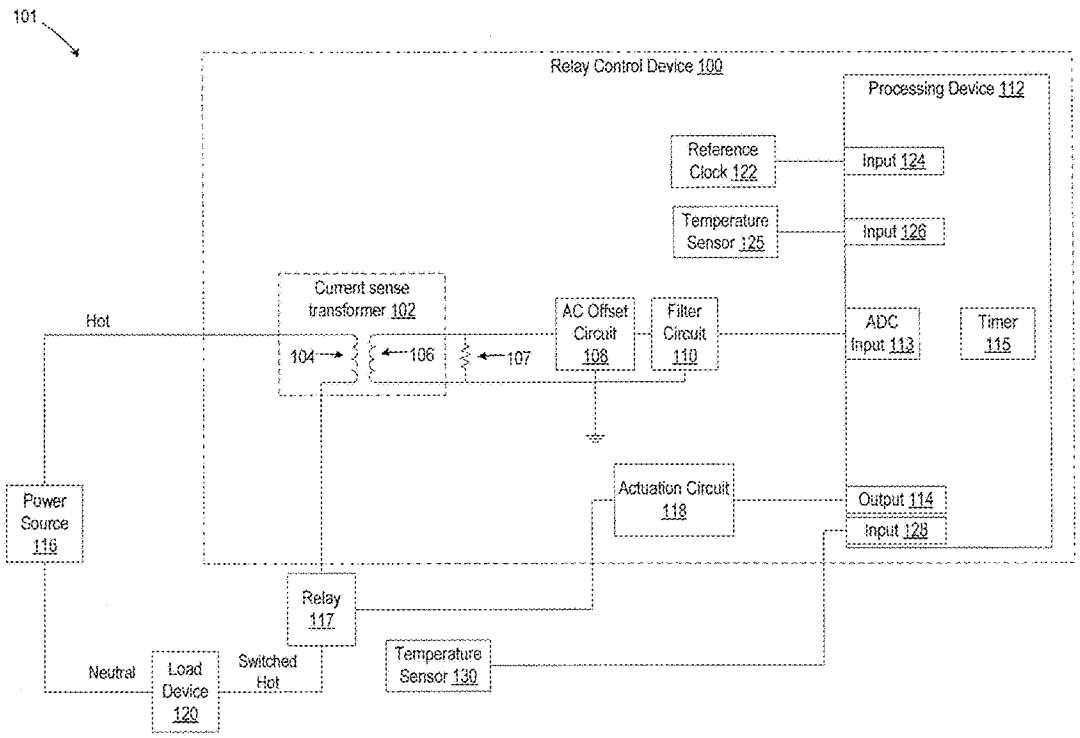
FIG. 1 is a block diagram illustrating an example of an electrical system in which a relay control device includes a current sense transformer that is used to obtain measurements of a load current for controlling actuation timing of a relay.

Aspects of the present invention involve using measurements of a load current obtained with a current sense transformer to control actuation of a relay. For example, an electrical system may include a load device, a relay that selectively allows current to flow from a power source to the load device, and a relay control device that uses measurements of the load current to control the timing of the relay. The relay control device can include a current sense transformer, a processing device, and a timer that is included in or communicatively coupled to the processing device.

The current sense transformer can be used to obtain data about the load current. For example, the processing device can cause the relay to be actuated at a first point in time (e.g., a randomly selected point in time or a default point in time). After the relay is actuated, the current sense transformer, which may include at least one winding that is electrically connected between a source of the load current and the load device, can be used to obtain measurement data about the load current. For example, the load current can flow through a primary winding of the current sense transformer, and an induced current (or some modified version of the induced current) that flows through a secondary winding of the current sense transformer can flow to an input pin of the processing device. The processing device can sample the voltage at the input pin to obtain measurement data about the load current. The processing device can use this load current data to determine both an actuation duration for the relay and a frequency of a line voltage from the power source.

The processing device can control subsequent actuations of the relay based on the determined actuation duration and line frequency. For example, the processing device can synchronize the timer with the line frequency. Synchronizing the timer with the line frequency allows that processing device to identify a zero-crossing point for the load current, since the waveform for the load current will correspond to the waveform for the line frequency. The synchronized timer can be used by the processing device to identify a zero-crossing point for the load current. Using the timer to identify this zero-crossing point can obviate the need to utilize specialized voltage detection circuit, which may require a connection to a neutral wire that may not be accessible on the relay or the relay control device. At a subsequent actuation of the relay, the processing device can cause the relay to be actuated at a time that is offset from the next zero-crossing point by the actuation duration (e.g., the relay contact actuation delay time). The zero-crossing point is identified or estimated using the synchronized timer. In some aspects, using a current sense transformer to measure the load current, determine the actuation duration, and synchronize a timer can allow a relay to start allowing current flow at a zero-crossing point of a load current without requiring separate circuitry for monitoring the relay and the line voltage.

In some aspects, the relay control device can use a current sense transformer to monitor current in an electrical system. The current sense transformer can be electrically connected in series with a line voltage, a relay, and a load device. This configuration can be used to directly monitor the load current and thereby obtain the waveform of the current through a load. In some aspects, using a current sense transformer in this configuration to monitor load current may obviate the need to use a separate voltage detector for monitoring the input voltage to the electrical system. In additional or alternative aspects, using a current sense transformer in this configuration to monitor load current can more accurately identify a current zero-crossing point as compared to using an AC input voltage waveform as an indicator of the current.

In some aspects, the relay control device described herein can reduce the complexity of control equipment used for various purposes in electrical systems. For example, the relay control device can use current sense transformer to measure current flowing to a load device in an electrical system, determine actuation delay timing for one or more relays in an electrical system, identify zero-crossing points for a current waveform, configure a relay to switch at a zero-crossing point, and synchronize a timer based on a frequency of a current waveform on an input line.

In some aspects, using a relay control device having a current sense transformer can provide accurate data regarding a zero-crossing point for current through a load. For example, a processing device that is included in or communicatively coupled to the current-sensing device can determine an actuation delay time for a relay in the electrical system using the current measurements that are obtained with the current sense transformer that is connected in series with the relay and load device. The processing device can control the timing for actuating the relay so that the relay is set to an "ON" state at a zero-crossing point of the load current waveform.

The relay control device can include a timer that is included in or communicatively coupled to a processing device. The timer can be synchronized using current measurements obtained using a current sense transformer. For example, the timer can be synchronized based on a frequency of a waveform of the input voltage that is applied to an electrical system (e.g., an input line voltage). The processing device can determine the frequency by sampling data from a waveform that is identified using load current measurements obtained with the current-sense transformer (e.g., via an analog-to-digital converter ("ADC") input of the processing device). The processing device can execute an algorithm specified by firmware or software to process the sampled data. A frequency of the sampled signal (e.g., 50 Hz, 60 Hz, etc.) can be used by the processing device to calibrate the timer such that the timer can be used to estimate a zero-crossing point of an load current when the relay is in an "OFF" state, as described in detail herein.

The subject matter of the present disclosure is described here with specificity to meet statutory requirements, but this description is not necessarily intended to limit the scope of the invention. The subject matter of this disclosure may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

FIG. 1 is a block diagram depicting a relay control device 100 that includes a current sense transformer 102 for use with current sensing functions. The relay control device 100 depicted in FIG. 1 includes a current sense transformer 102, an AC offset circuit 108, a filter circuit 110, and a processing device 112. The relay control device 100 can be included in or electrically connected to an electrical system 101 that includes a load device 120 that is electrically connected to a relay 117 and a power source 116.

Figure 2:
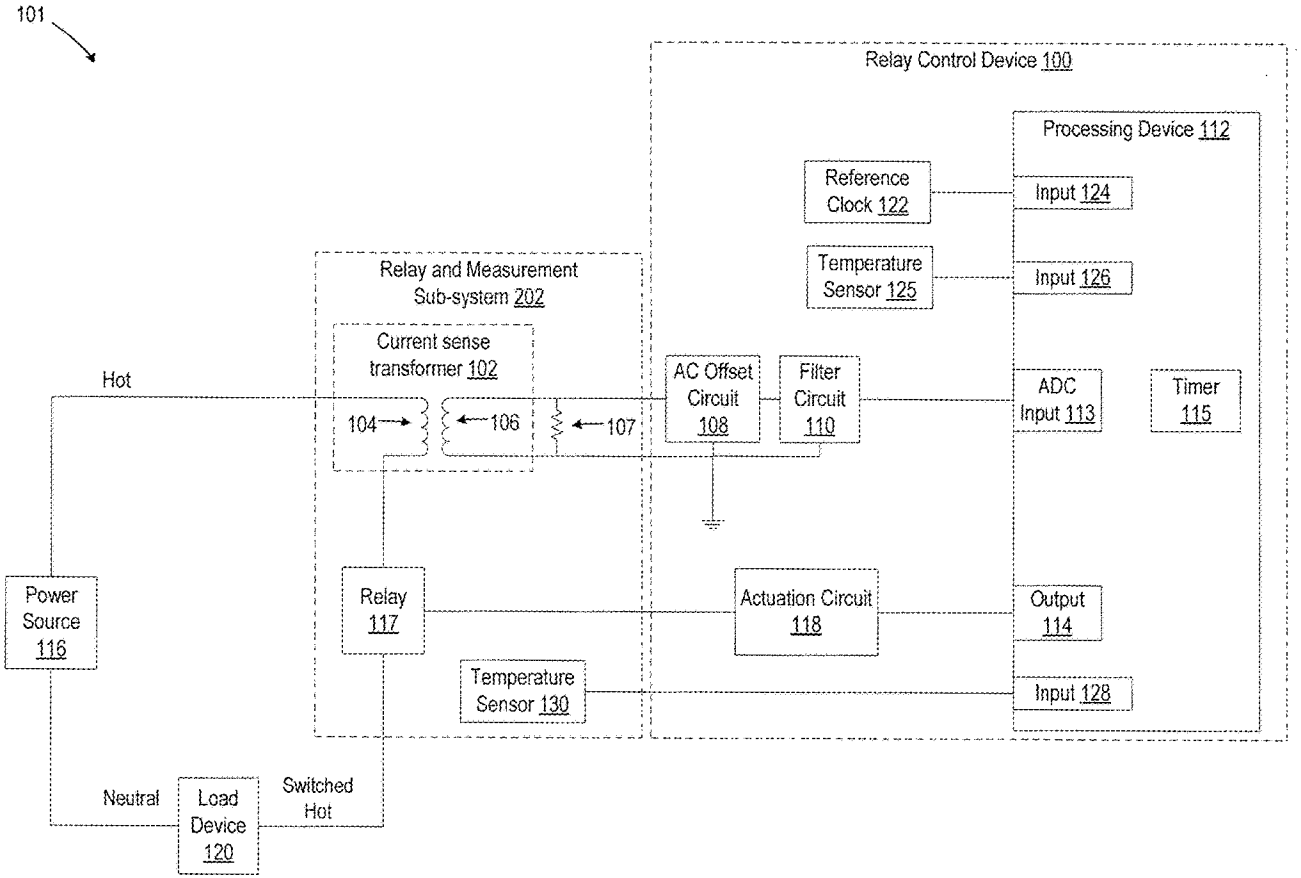
FIG. 2 is a block diagram illustrating an alternative example of an electrical system in which a relay and measurement sub-system with a current sense transformer is used to obtain measurements of a load current that are used by a relay control device that controls actuation timing of the relay.

In the example depicted in FIG. 1, the relay control device 100 is depicted as being separate from the relay 117. However, other implementations are possible. For example, in some aspects, the relay 117 may be included on the same printed circuit board assembly as the relay control device 100. In other aspects, one or more components of the relay control device 100 can be separate from the current sense transformer 102 and the relay 117. For example, FIG. 2 depicts an implementation in which the current sense transformer 102 and the relay 117 are implemented in a relay and measurement sub-system 202. In some aspects, the relay control device 100 can be implemented on a first printed circuit board, and the relay and measurement sub-system 202 can be implemented on a second printed circuit board.

The systems depicted in FIGS. 1 and 2 are provided for purposes of illustration only. Other implementations are possible. For example, one or more of the current sense transformer 102, the AC offset circuit 108, the filter circuit 110, the processing device 112, the relay 117, the actuation circuit 118, and the load device 120 can be implemented in the same device (e.g., a printed circuit board), in different devices (e.g., different printed circuit boards), or any combination thereof.

The relay control device 100 can be electrically coupled to a power source 116, a relay 117, an actuation circuit 118, and a load device 120. In some aspects, the relay 117 can have an open position in which the power source 116 is not coupled to the load device 120 via the relay 117, and the relay 117 can have a closed position in which the power source 116 is coupled to the load device 120 via the relay 117. However, the relay control device 100 described herein can be used with any relay 117 that is configurable in at least one state that allows current flow (i.e., an "on" state) and at least one additional state that prevents current flow (i.e., an "off" state). The power source 116 can provide a sinusoidal voltage waveform to the load device 120 via the relay 117 in a closed position.

In one example, the relay 117 can include an armature and any number of electrical contacts. In an "OFF" state, an armature of the relay can be disconnected or otherwise distal from a contact of the relay 117 through which current can flow to the load device 120. In an "ON" state, an armature of the relay can be connected to the contact of the relay 117 through which current can flow to the load device 120. An actuation coil near the armature can be used to provide a magnetic field or other force that causes a movement of the armature. Such an actuation coil can include, for example, a coil of wire helically surrounding an iron core. An electrical current passing through the actuation coil can generate a magnetic field that causes an armature of the relay 117 to a position that allows current flow to the load device 120. Ceasing to provide the voltage or electrical current to the actuation coil can cause the magnetic field to cease. In the absence of the magnetic field, the armature of the relay 117 can move to a position that prevents current flow to the load device 120.

The above description of the relay 117 is provided for illustrative purposes only. Any suitable relay that uses any suitable actuation scheme can be used without departing from the scope of the concepts disclosed herein. For example, the relay 117 may be a latching relay in which a pulse, rather than a continuous current, is used to change the state of the relay between an "ON" state and an "OFF" state.

Any suitable actuation circuit 118 may be used to drive or control a relay 117. Driving or controlling the relay can 117 can include causing an electrical current to flow through an actuation coil of the relay. Examples of actuation circuits 118 that may be used to drive or control the relay 117 are described below with respect to FIGS. 4 and 8.

The relay control device 100 can be used to monitor current flow to the load device 120 and to use the monitored current to control the operation of the relay 117. The current sense transformer 102 includes a primary winding 104 that is inductively coupled to a secondary winding 106. In some aspects, the primary winding 104 is electrically coupled to high-voltage, high-current circuits and devices (e.g., circuits electrically coupling a power source 116 to a load device 120). For example, a 480 Vac line voltage can be used with a relay 117 and a current sense transformer 102 that is rated for that operating voltage. In some aspects, the secondary winding 106 is electrically coupled to low-voltage, low-current circuits and devices (e.g., circuits that include a microprocessor or other processing device 112).

The relay control device 100 can also include a burden resistor 107. The burden resistor 107 can be electrically coupled in parallel with the secondary winding 106 of the current sense transformer 102. The burden resistor 107 can provide a current leakage path across the secondary winding 106. Providing the current leakage path can limit the maximum voltage across the secondary winding 106.

In some aspects, the current sense transformer 102 can be used in an electrical system if a current for a load device 120 exceeds a threshold. The threshold load current can be determined based on the properties of the current sense transformer 102 and the resolution of an ADC in the processing device 112. In some aspects, the threshold load current is a limiting factor of the components used in the system (e.g., a maximum rated current of the relay, a maximum rated current of a current sense transformer or other current-sensing device, a maximum current on the traces of a printed circuit board used to implement the electrical system, etc.). For example, the processing device 112 can measure the sampled current and calculate a corresponding root mean square ("RMS") load current. The processing device 112 can automatically determine if the calculated RMS current exceeds a predetermined threshold load current. The processing device 112 can be preprogrammed to turn off the relay 117 if the load current exceeds the predetermined threshold.

The relay control device 100 can also include an AC offset circuit 108. The AC offset circuit 108 can shift a DC component of a waveform generated using the current sense transformer 102. The AC offset circuit 108 can offset an AC signal received from the current sense transformer 102 such that negative voltages are eliminated from a sensed signal that is provided to the processing device 112.

The relay control device 100 can also include a filter circuit 110. The filter circuit 110 can protect a processing device 112 from noise. For example, noise on the line voltage (e.g., the voltage present on the wire labeled "hot" in FIG. 1) may be propagated through the current sense transformer 102. The filter circuit 110 can remove or reduce this noise prior to a waveform being provided to the processing device 112 via an ADC input 113.

The current sense transformer 102 can be used to identify an amount of current flowing to a load device 120. For example, a power source 116 may be electrically coupled to a load device 120 via a "hot" wire via the primary winding 104 of the current sense transformer. A first terminal of the primary winding 104 can be electrically coupled to the power source 116 and a second terminal of the primary winding 104 can be electrically coupled to one or more components of the load device 120. A return current path from the load device 120 to the power source 116 can be provided by the wire labeled "neutral" in FIG. 1. In some embodiments, the relay 117 can be used to selectively connect the load device 120 to the power source 116 via the return current path (e.g., the neutral wire).

The processing device 112 can be used to control the relay 117, to monitor operations involving the relay 117, or some combination thereof. For example, the processing device 112 can be electrically coupled to the secondary winding 106 via the AC offset circuit 108 and the filter circuit 110. An AC current through the secondary winding 106 can be offset by the AC offset circuit 108 and filtered by the filter circuit 110. The offset, filtered signal can be provided to an ADC input 113 of the processing device 112. The processing device 112 can convert the analog signal received via the AC offset circuit and the filter circuit 110 into a digital signal. The processing device 112 can execute one or more algorithms using data from the digital signal that has been obtained using the current sense transformer 102.

The algorithms executed by the processing device 112 can be used to control or monitor operations involving the relay 117. For example, the processing device 112 can also be electrically coupled to an actuation circuit 118. The processing device 112 can execute one or more algorithms using the signals received via the ADC input 113 to generate one or more output signals. For example, the processing device 112 can provide an output signal to the actuation circuit 118 via the output 114. The output signal can cause the actuation circuit 118 to actuate the relay 117.

The processing device 112 can include or be communicatively coupled to a timer 115 and can be communicatively coupled to a reference clock 122 via an input 124. The reference clock 122 can be a free-running, high-accuracy timer. Examples of the reference clock 122 include (but are not limited to) an accurate crystal (e.g., 10 parts per million or better), an oscillator, a resonator, etc.

The processing device 112 can synchronize the timer 115 with a frequency of the load current and thereby provide an estimate of zero-crossing points for the load current to the load device. The processing device 112 can synchronize the timer 115 using measurements of load current that are obtained using the current sense transformer 102 and clock ticks (e.g., pulses) provided by the reference clock 122. The processing device 112 uses the measurements of load current to identify a voltage or current waveform (e.g., a waveform of a load current and/or an input voltage used to generate the load current). The identified waveform is used by the processing device 112 to identify one or more zero-crossing points of the load current. The clock ticks provided by the reference clock 122 are used to measure the time between zero-crossing points of the load current.

The timer 115 can count clock ticks received from the reference clock 122. The processing device 112 can reset the count of the timer 115 based on an actual zero-crossing point for an input signal (e.g., when the relay 117 is in an "ON" state) or an estimated zero-crossing point for the input signal (e.g., when the relay 117 is in an "OFF" state). For example, when the relay 117 is in an "ON" state, the actual zero-crossing point for the input signal can be determined using current measurements obtained with the current sense transformer 102, and when the relay 117 is in an "OFF" state, the zero-crossing point for the input signal can be estimated using measurements of the time between zero-crossing points that were determined during one or more prior periods when the relay 117 was in an "ON" state.

To obtain the time measurements when the relay 117 is in an "ON" state, the processing device 112 can identify a first zero-crossing point in an input signal (e.g., a load current waveform). The processing device 112 can reset the timer 115 in response to determining that the first zero-crossing point has been encountered. The timer 115 can start counting clock ticks that are received from the reference clock 122 after the first zero-crossing point and a second zero-crossing point. The processing device 112 can reset the timer 115 again in response to determining that the second zero-crossing point has been encountered. (For example, if the input signal has a frequency of 60 Hz, and the reference clock 122 operates at a frequency of 20 MHz, the timer 115 may count 166,666 clock ticks between the first zero-crossing point and the second zero-crossing point.) The processing device 112 can store the number of clock ticks that were measured between the first and second zero-crossing points. In some aspects, as the relay 117 continues in the "ON" state, multiple measurements of clock ticks between multiple sets of zero-crossing points are stored. The processing device 112 can average the stored counts of clock ticks.

When the relay 117 is in an "OFF" state, the processing device 112 can use a stored clock tick count (e.g., an average of clock tick counts when the relay was in an "ON" state), rather than identified zero-crossing points in an input signal, to reset the timer 115. For example, the timer 115 can continue counting clock ticks after the relay 117 has been set to the "OFF" state. The processing device 112 can determine that the number of counted clock ticks reaches or exceeds the stored clock tick count. The processing device 112 can reset the timer 115 in response to determining that the number of counted clock ticks has reached the stored clock tick count. The timer 115 can continue counting clock ticks and being reset in this manner when the relay 117 is in an "OFF" state. The counting and resetting of the timer 115 can approximate the input signal encountering zero-crossing points.

In this manner, the timer 115 can be synchronized with the frequency of an input signal. The processing device 112 can use the synchronized timer 115 to identify, estimate, or otherwise determine a zero-crossing point for the input voltage or current waveform. The processing device 112 can use a zero-crossing point that is identified or estimated using the timer 115 to control the actuation timing for the relay 117, as described in detail herein. (Although FIG. 1 depicts the timer 115 as being included in the processing device 112, any embodiments, aspects, or examples described herein may use a timer 115 that is external to and communicatively coupled to the processing device 112.)

The operating frequency of the reference clock 122 (e.g., how often the reference clock 122 provides clock ticks to the processing device 112) may vary with the temperature of the reference clock 122. For example, during a given period of time, 166,666 ticks may be received from the reference clock 122 if the reference clock 122 has a temperature of 25° C. and 167,000 ticks may be received from the reference clock 122 if the reference clock 122 has a temperature of 50° C. Thus, different numbers of clock ticks received at different operating temperatures of the reference clock 122 may indicate the same interval of time.

In some aspects, the relay control device 100 can compensate for changes in the operating temperature of the reference clock 122. The relay control device 100 can include a temperature sensor 125 that is communicatively coupled to the processing device 112 via an input 126. The temperature sensor 125 can measure a temperature of the reference clock 122 or a temperature sufficiently close to the reference clock 122. The temperature measurement point may be sufficiently close to the reference clock 122 if the measured temperature can be used to determine changes in the frequency with which the reference clock 122 provides clock ticks to the processing device 112.

To compensate for the changes in operating temperature, the processing device 112 can store clock tick counts along with measured operating temperatures of the reference clock 122. For example, the processing device 112 can receive temperature measurements of the reference clock 122 during a time period in which the timer 115 is being synchronized with the frequency of an input signal. The processing device 112 can associate a first number of clock ticks (e.g., an average clock tick count, as described above) with a first operating temperature during which the first number was determined. The processing device 112 can associate a second number of clock ticks (e.g., an average clock tick count, as described above) with a second operating temperature during which the second number was determined.

When the relay 117 is in an "OFF" state, the processing device 112 can use a measured temperature of the reference clock 122 and the associations between clock tick count and operating temperature to reset the timer 115. For example, the timer 115 can continue counting clock ticks after the relay 117 has been set to the "OFF" state. The processing device 112 can determine the operating temperature of the reference clock 122 using the temperature sensor 125. If the operating temperature is sufficiently close to the first temperature, the processing device 112 can select the first number of clock ticks associated with the first temperature. If the operating temperature is sufficiently close to the second temperature, the processing device 112 can select the second number of clock ticks associated with the second temperature. In some aspects, the closeness of the measured operating temperature to a stored temperature value can be determined based on the measured operating temperature being within a threshold of the stored temperature value. In additional or alternative aspects, a stored temperature can be selected based on the measured operating temperature being closer to that stored temperature value than another stored temperature value.

As the timer 115 counts, the processing device 112 can determine when the number of clock ticks counted by the timer 115 reaches the selected clock tick count that has been identified using temperature data. The processing device 112 can reset the timer 115 in response to determining that the number of counted clock ticks has reached or exceeded the selected clock tick count. The timer 115 can continue counting clock ticks and being reset in this manner when the relay 117 is in an "OFF" state. The counting and resetting of the timer 115 can approximate the input signal encountering zero-crossing points.

In some aspects, a temperature sensor 130 can be communicatively coupled to the processing device via an input 128. The temperature sensor 130 can measure a temperature of the relay 117 or a temperature sufficiently close to the relay 117. The temperature measurement point may be sufficiently close to the relay 117 if the measured temperature can be used to determine temperature-dependent changes in the actuation duration of the relay 117 (e.g., a first time for changing between an "ON" and "OFF" state corresponding to a first temperature and a second time for changing between an "ON" and "OFF" state corresponding to a second temperature).

In some aspects, the temperature sensor 125 and the temperature sensor 130 can be replaced with a single temperature sensor. In one example, the relay 117 and the reference clock 122 may be positioned sufficiently close together such that a temperature measurement taken by the same temperature sensor can be used to determine temperature-dependent changes in the actuation duration of the relay 117 and can also be used to determine changes in the frequency with which the reference clock 122 provides clock ticks to the processing device 112. In another example, if a relationship between the temperature of the relay 117 and the temperature of the reference clock 122 is stored in a non-transitory computer-readable medium accessible to the processing device, the relationship can be used by the processing device 112 to identify the temperature of the relay 117 or the temperature of the reference clock 122. For example, if a temperature measurement for the reference clock 122 is received from the temperature sensor 125, the processing device 112 can use a relationship between the temperature of the relay 117 and the temperature of the reference clock 122 to convert the temperature measurement for the reference clock 122 to temperature date for the relay 117 (or vice versa). This conversion operation can obviate the need for the temperature sensor 130 near the relay 117.

The relay control device 100 can be used with a wide range of input voltages (e.g., 120-277 Vac at 50/60 Hz) provided by the power source 116. In some aspects, the relay control device 100 can be used in 347 Vac applications, depending on component construction and insulation rating.

FIGS. 1 and 2 depict examples of implementations in which the relay 117 is connected to a "hot" wire. A first terminal of the primary winding 104 can be electrically coupled to the power source 116 via a "hot" wire. A load device 120 can be electrically coupled the relay 117 via a "switched hot" wire. The relay 117 can be used to selectively connect the primary winding 104 to one or more components of the load device 120. A return current path from the load device 120 to the power source 116 can be provided by the neutral wire or another suitable conductor. These implementations depicted in FIGS. 1 and 2 are provided for purposes of illustrations. Other implementations are possible.

In some aspects, the electrical systems depicted in FIGS. 1 and 2, including one or more of the relay control device 100, the relay 117, the actuation circuit 118, and the load device 120, can be implemented using a printed circuit board or other suitable device. In additional or alternative aspects, one or more of the relay control device 100, the relay 117, the actuation circuit 118, and the load device 120, can be implemented as separate devices that are electrically coupled together to provide the functionality depicted in FIGS. 1 and 2.

Figure 3:
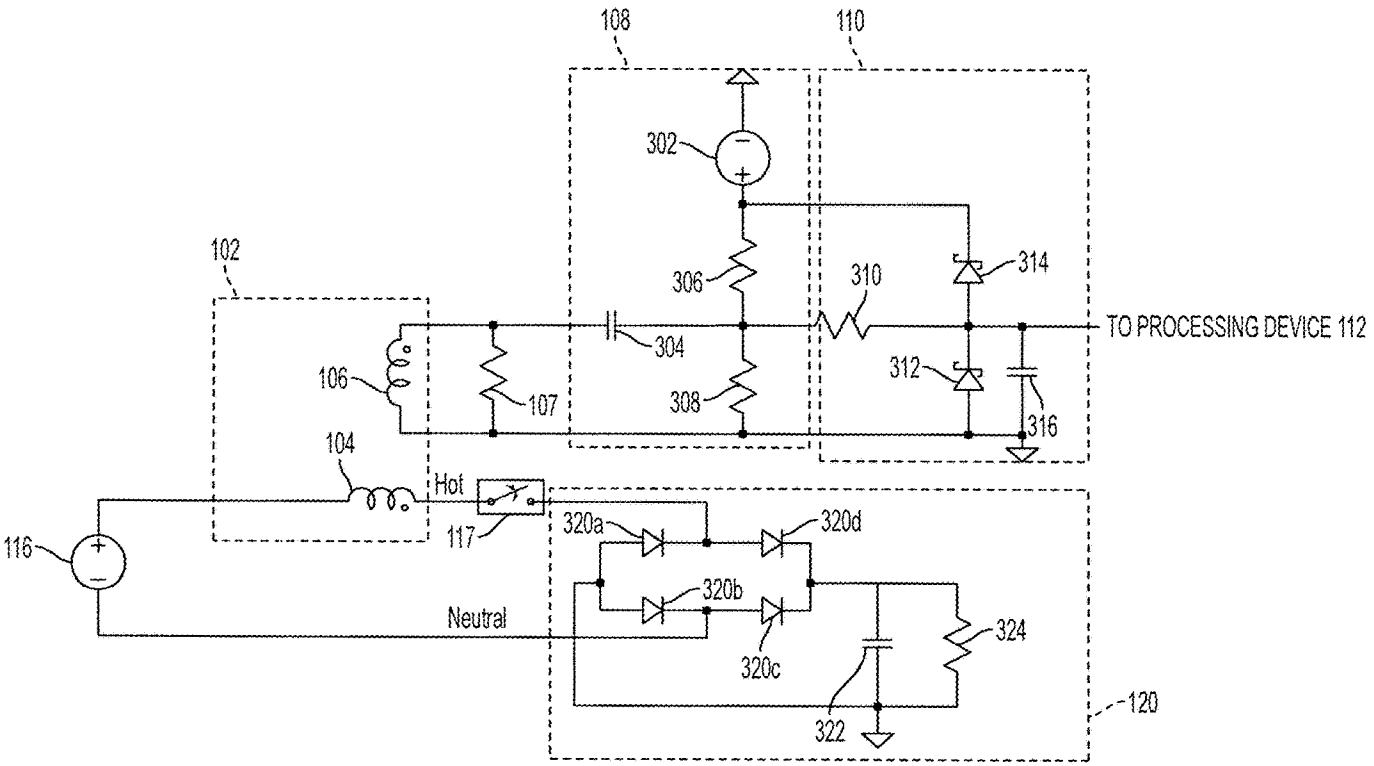
FIG. 3 is a schematic diagram illustrating an example of an electrical system in which measurements of a load current are obtained using a current sense transformer and are used for controlling actuation timing of a relay.

FIG. 3 is a schematic diagram depicting a non-limiting example of the relay control device 100. In the example depicted in FIG. 3, the AC offset circuit 108 includes a low digital voltage power supply 302, a coupling capacitor 304, and a voltage divider provided by resistors 306, 308. In some aspects, the power supply 302 can be integrated with a printed circuit board used to implement the relay control device 100.

An example of the power supply 302 is a 3.3 V power supply. A 3.3 V power supply 302 in combination with the voltage divider provided by the resistors 306, 308 can offset an AC signal, which is received from the secondary winding 106, by 1.65 V.

The example of the AC offset circuit 108 depicted in FIG. 3 is provided for purposes of illustration. Other implementations of the AC offset circuit 108 may be used. For example, an AC offset circuit 108 can have a topology that includes an operational amplifier and a negative power supply (e.g., −3.3 Vdc).

The load device 120 can include any type of device (e.g., a fluorescent ballast or driver, a resistive or incandescent load, a magnetic load, etc.) to which electrical current may be provided. For example, FIG. 3 depicts a simulated load device 120 having components such as diodes 320*a-d*, a filter capacitor 322, and a load resistor 324. The components depicted in FIG. 3 can be included in or simulate an electronic driver or ballast. However, any suitable load device can be used in place of the load device 120 depicted in FIG. 3.

Figure 4:
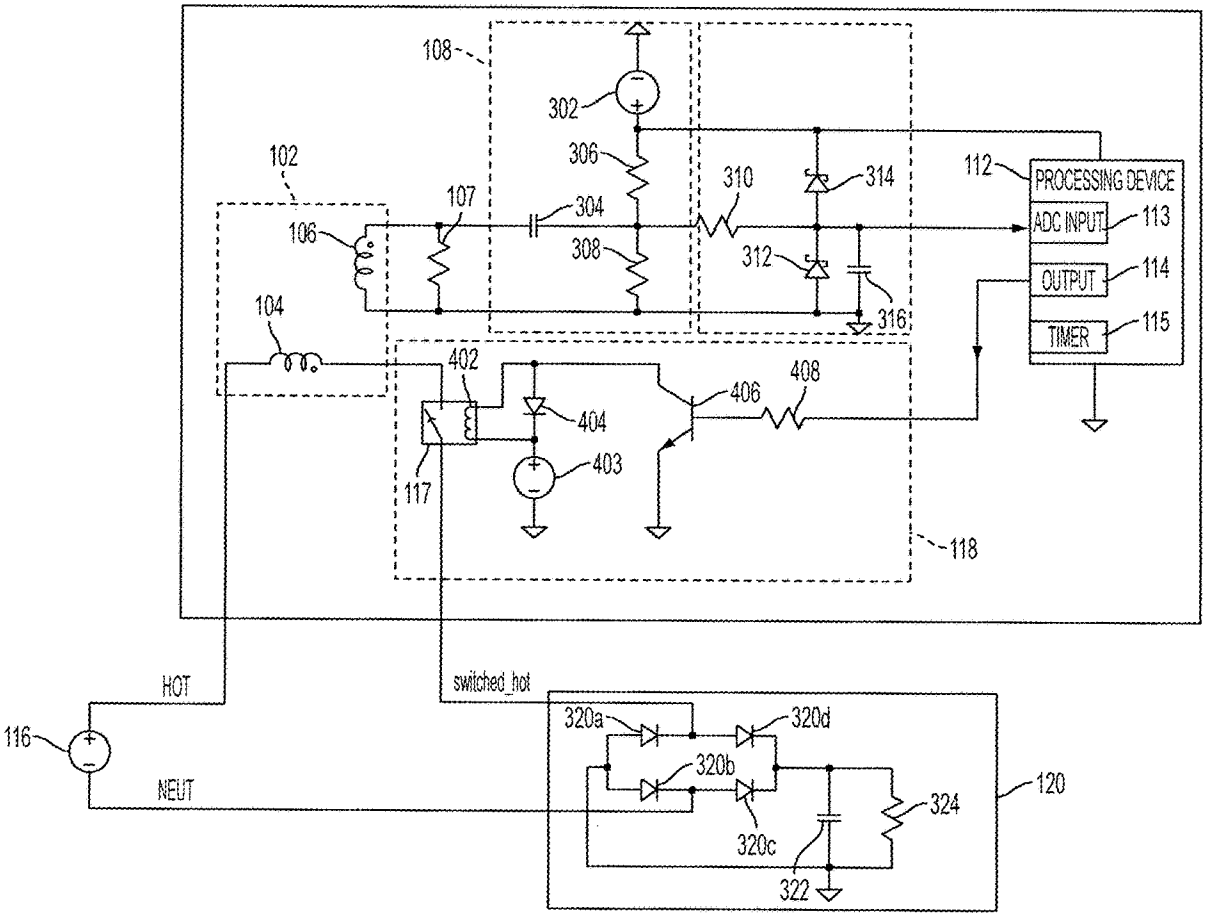
FIG. 4 is a schematic diagram illustrating an alternative example of an electrical system in which measurements of a load current are obtained using a current sense transformer and are used for controlling actuation timing of a relay.

Any suitable actuation circuit 118 can be used with the relay control device 100. For example, FIG. 4 is a schematic diagram depicting a non-limiting example of an actuation circuit 118 for a relay 117 that is controlled using an output from the processing device 112. In this example, the actuation circuit 118 is used to actuate a relay 117 with electrically held contacts. (For illustrative purposes, certain components of processing device 112 and other components depicted in FIGS. 1 and 2 have been omitted from FIG. 4; however, the implementation depicted in FIG. 4 can be used with any and all of the components depicted in FIGS. 1 and 2.)

This actuation circuit 118 depicted in FIG. 4 includes an actuation coil 402, a flyback protection diode 404, a switching transistor 406, and a bias resistor 408. The transistor 406 is depicted in FIG. 4 for illustrative purposes only. The actuation circuit 118 can include any suitable transistor or other switching component that may be actuated by a signal from a processing device 112. Non-limiting examples of suitable switching components include bipolar junction transistors, MOSFETs, opto-couplers, or any other type of switching electronic component or circuitry.

A voltage source 403 can be used to provide an actuation current to the actuation coil 402 that is used to cause an armature of the relay 117 to move from an open position to a closed position (or vice versa). The voltage source 403 can include, for example, a voltage source that can provide a low voltage such as (but not limited to) 5 V, 12 V, 24 Vdc, etc.

The actuation circuit depicted in FIG. 4 is provided for illustrative purposes only. Any compatible actuation circuit 118 can be used for a given type of relay used in electrical systems such as those depicted in FIGS. 3 and 4. For example, an H-bridge driving circuit can be used for a single coil latching relay, a two-transistor driving circuit can be used for dual coil latching relays, a gate drive circuit can be used for solid state relays, etc.

Figure 5:
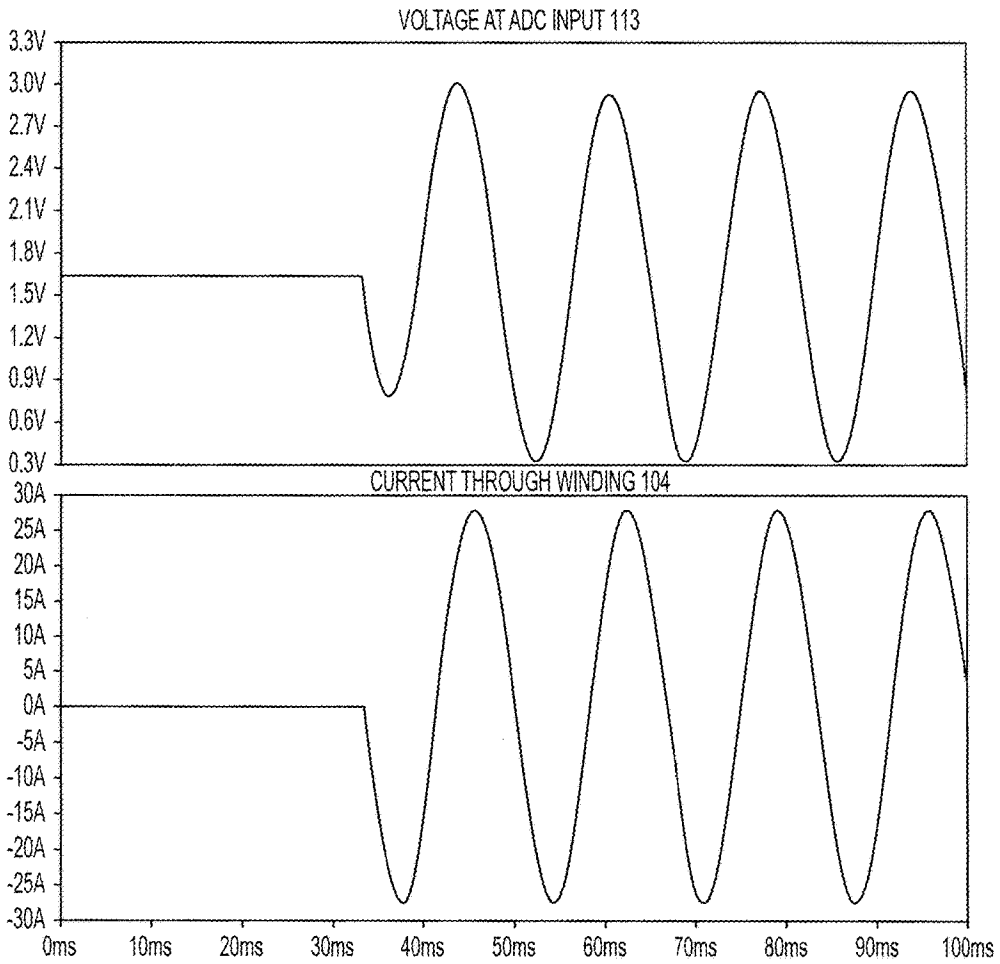
FIG. 5 is a diagram depicting examples of a current through a primary winding of the current sense transformer depicted in FIGS. 3 and 4 and a corresponding voltage detected using current through the secondary winding of the current sense transformer when the current sense transformer is used in an electrical system with a resistive load.
Figure 6:
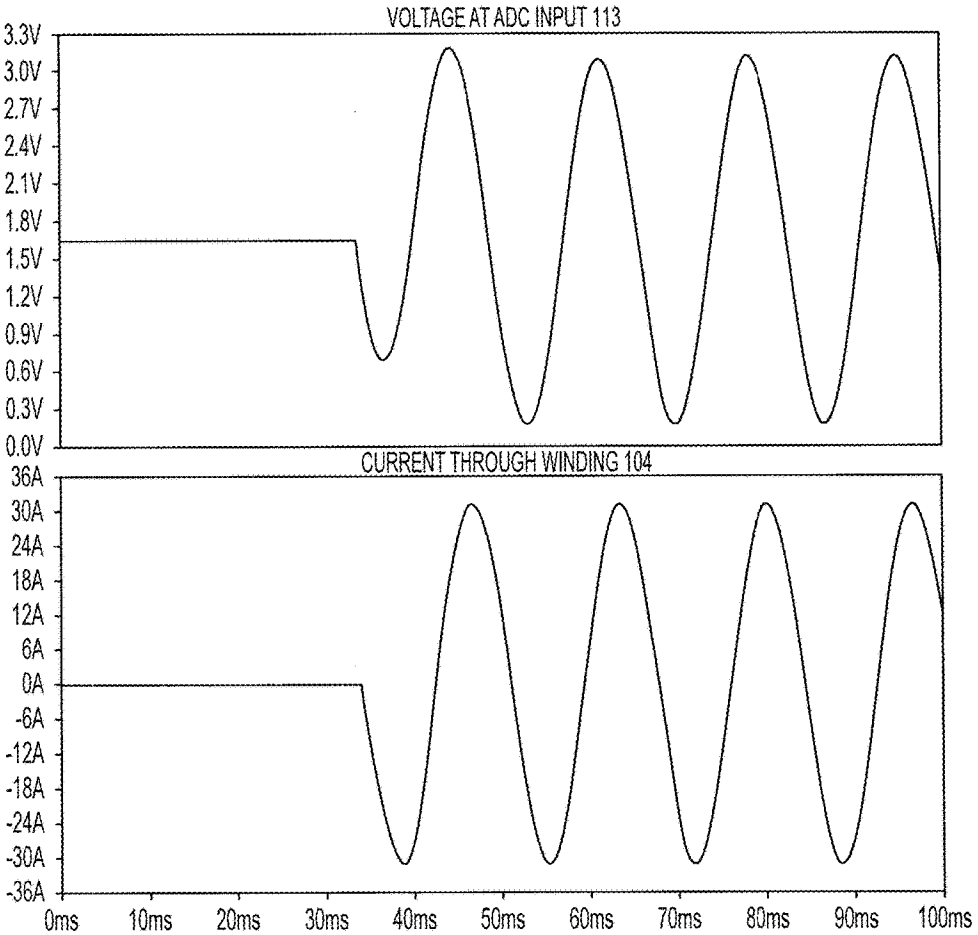
FIG. 6 is a diagram depicting examples of a current through a primary winding of the current sense transformer depicted in FIGS. 3 and 4 and a corresponding voltage detected using current through the secondary winding of the current sense transformer when the current sense transformer is used in an electrical system with a magnetic load.
Figure 7:
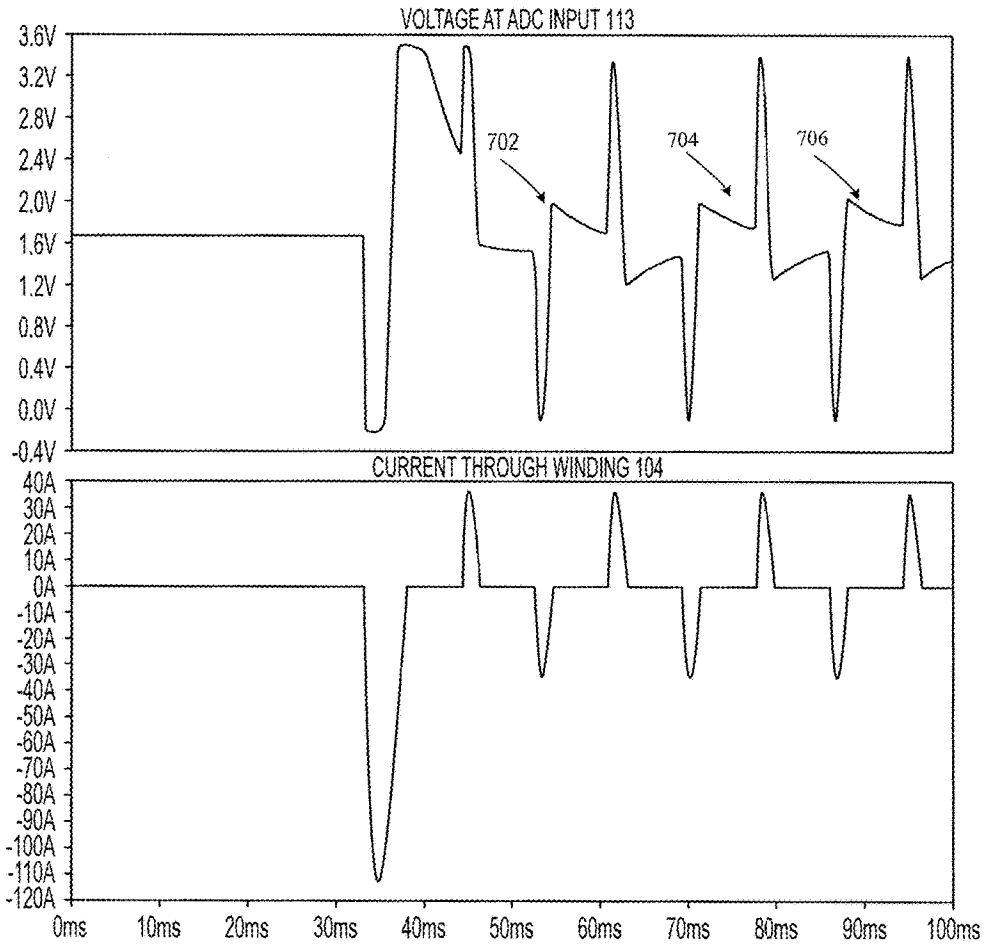
FIG. 7 is a diagram depicting examples of a current through a primary winding of the current sense transformer depicted in FIGS. 3 and 4 and a corresponding voltage detected using current through the secondary winding of the current sense transformer when the current sense transformer is used in an electrical system with an electronic load.

FIGS. 5-7 depict examples of waveforms for a current provided to different types of load devices 120 in the electrical system 101 depicted in FIGS. 3 and 4. FIG. 5 depicts examples of waveforms for a resistive load device 120 that is turned on after a 33.3 millisecond delay. The delay, which can equal or otherwise correspond to an actuation duration for the relay 117, may be a difference between the time at which an actuation signal is provided to the actuation circuit 118 and a time at which current begins flowing through the relay 117 and the winding 104. The lower waveform is a current through a primary winding 104 of the current sense transformer 102 and corresponds to the load current through the load device 120. The upper waveform is the corresponding voltage received at the ADC input 113 of the processing device 112 from the secondary winding 106 of the current sense transformer 102 as modified by the AC offset circuit 108. The voltage received at the ADC input 113 of the processing device 112 is obtained using the current sense transformer 102 and is offset by a suitable AC offset circuit 108.

As depicted in FIG. 5, the voltage at the ADC input 113 has a DC component of 1.65 V that corresponds to the 1.65 V offset provided by the AC offset circuit 108. The times at which the voltage at the ADC input 113 has a value at the DC component (e.g., 50 ms, 66 ms, etc.) correspond to zero-crossing points for the load current waveform (e.g., the current through winding 104).

FIG. 6 depicts examples of waveforms for an electronic load device 120 (e.g., a ballast or driver) that is turned on after a 33.3 millisecond delay (e.g., the time of an actuation signal plus the actuation duration). The lower waveform is a current through the primary winding 104 of the current sense transformer 102 and corresponds to the load current through the load device 120. The upper waveform is the corresponding voltage received at the ADC input 113 of the processing device 112 from the secondary winding 106 of the current sense transformer 102 as modified by the AC offset circuit 108. The voltage received at the ADC input 113 of the processing device 112 is obtained using the current sense transformer 102 and is offset by a suitable AC offset circuit 108.

As depicted in FIG. 6, the voltage at the ADC input 113 has a DC component of 1.65 V that corresponds to the 1.65 V offset provided by the AC offset circuit 108. The times at which the voltage at the ADC input 113 has a value at the DC component correspond to zero-crossing points for the load current waveform (e.g., the current through winding 104).

FIG. 7 depicts examples of waveforms for a magnetic load device 120 that is turned on after a 33.3 millisecond delay. The lower waveform is a current through the primary winding 104 of the current sense transformer 102 and corresponds to the current through the load device 120. The upper waveform is the corresponding voltage received at the ADC input 113 of the processing device 112. The voltage received at the ADC input 113 of the processing device 112 is obtained using the current sense transformer 102 and is offset by a suitable AC offset circuit 108. For the load current waveform depicted in FIG. 7, a current sense discontinuity in the sampled load current waveform can be ignored or filtered by an algorithm executed by the processing device 112.

As depicted in FIG. 7, the voltage at the ADC input 113 has a DC component of 1.65 V that corresponds to the 1.65 V offset provided by the AC offset circuit 108. The times at which the voltage at the ADC input 113 has a value at the DC component or within a threshold value of the DC component (e.g., the waveform portions 702, 704, 706) correspond to zero-crossing points for the load current waveform (e.g., the current through winding 104).

Figure 8:
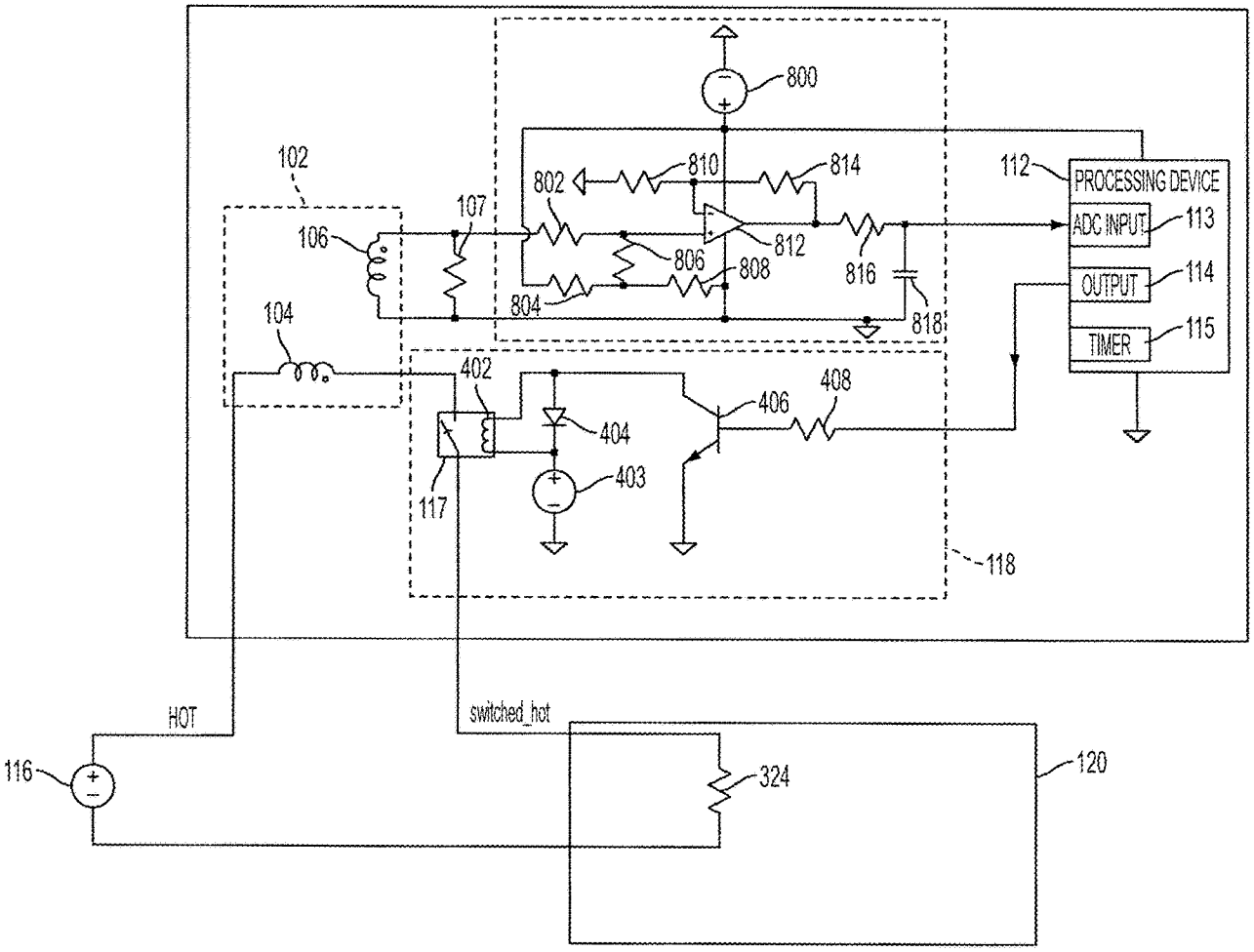
FIG. 8 is a schematic diagram illustrating an alternative example of the electrical system depicted in FIG. 2.

In additional or alternative aspects, other implementations of the AC offset circuit may be used. For example, FIG. 8 is a schematic diagram that depicts a relay control device 100 with an alternative example of an AC offset circuit 108. The AC offset circuit 108 depicted in FIG. 8 includes a resistor network (e.g., resistors 802, 804, 806, 808, 810, 814, 816), an operational amplifier 812, and a capacitor 818. A voltage source 800 can be used to provide a voltage (e.g., 3.3 V, 5 V, etc.) to the operational amplifier 812. The operational amplifier 812 can offset the waveform through the secondary winding 106. For example, the operational amplifier 812 can provide a DC offset of 1.65 V.

For illustrative purposes, certain components of processing device 112 and other components depicted in FIGS. 1 and 2 have been omitted from FIG. 8; however, the implementation depicted in FIG. 8 can be used with any and all of the components depicted in FIGS. 1 and 2.

Figure 9:
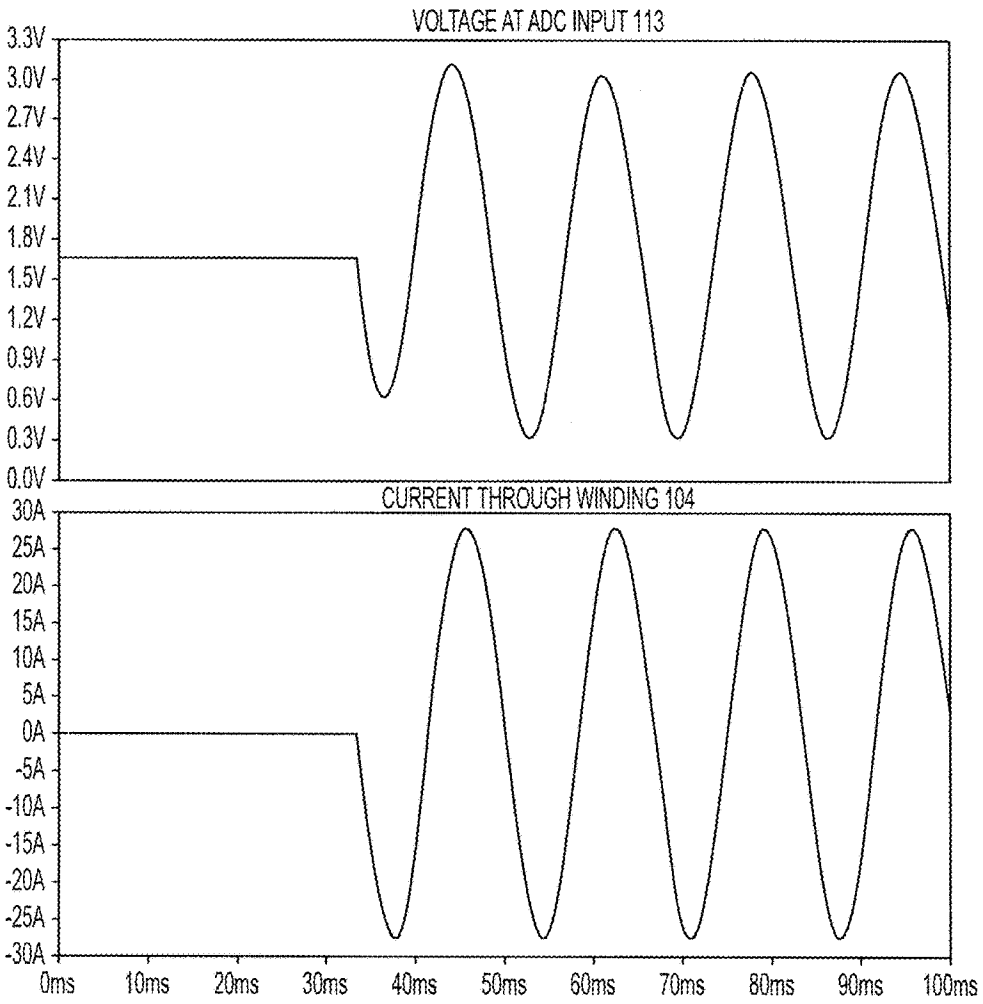
FIG. 9 is a diagram depicting examples of a current through a primary winding of the current sense transformer depicted in FIG. 8 and a corresponding voltage detected using current through the secondary winding of the current sense transformer when the current sense transformer is used in an electrical system with a resistive load.
Figure 10:
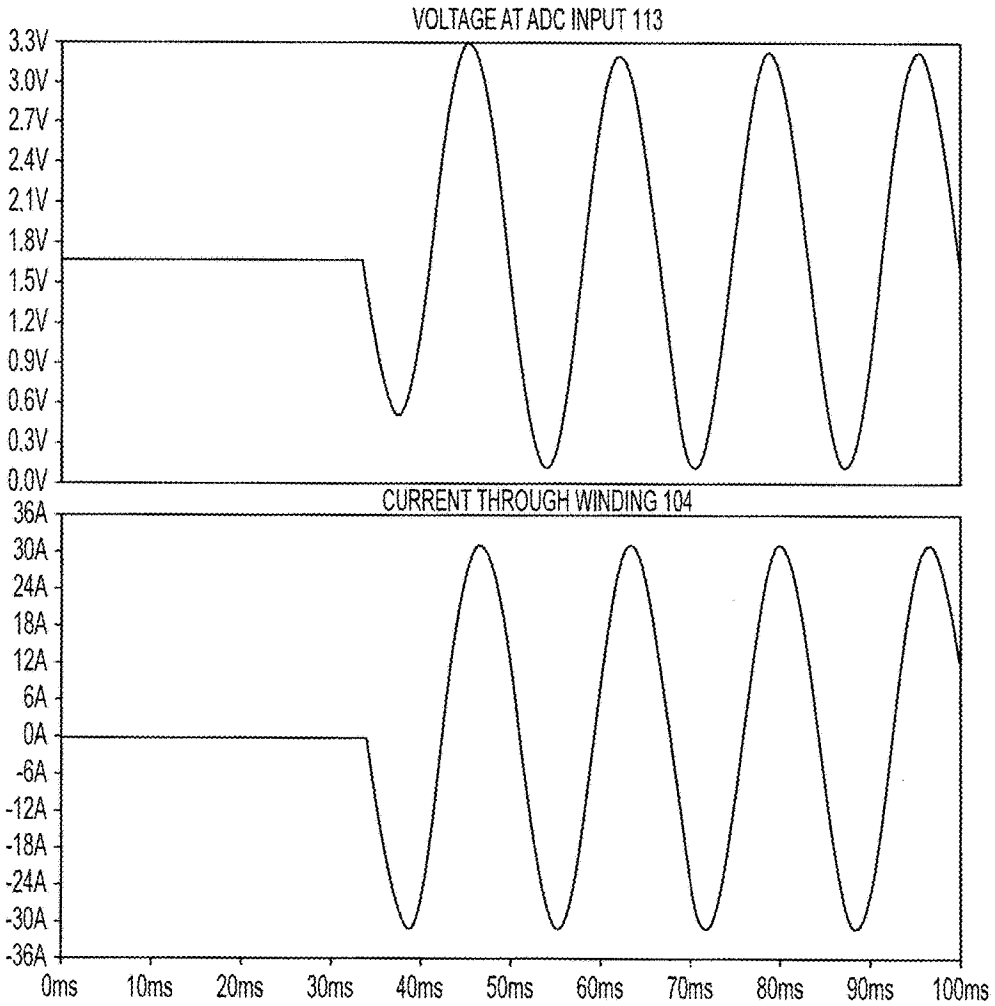
FIG. 10 is a diagram depicting examples of a current through a primary winding of the current sense transformer depicted in FIG. 8 and a corresponding voltage detected using current through the secondary winding of the current sense transformer when the current sense transformer is used in an electrical system with a magnetic load.
Figure 11:
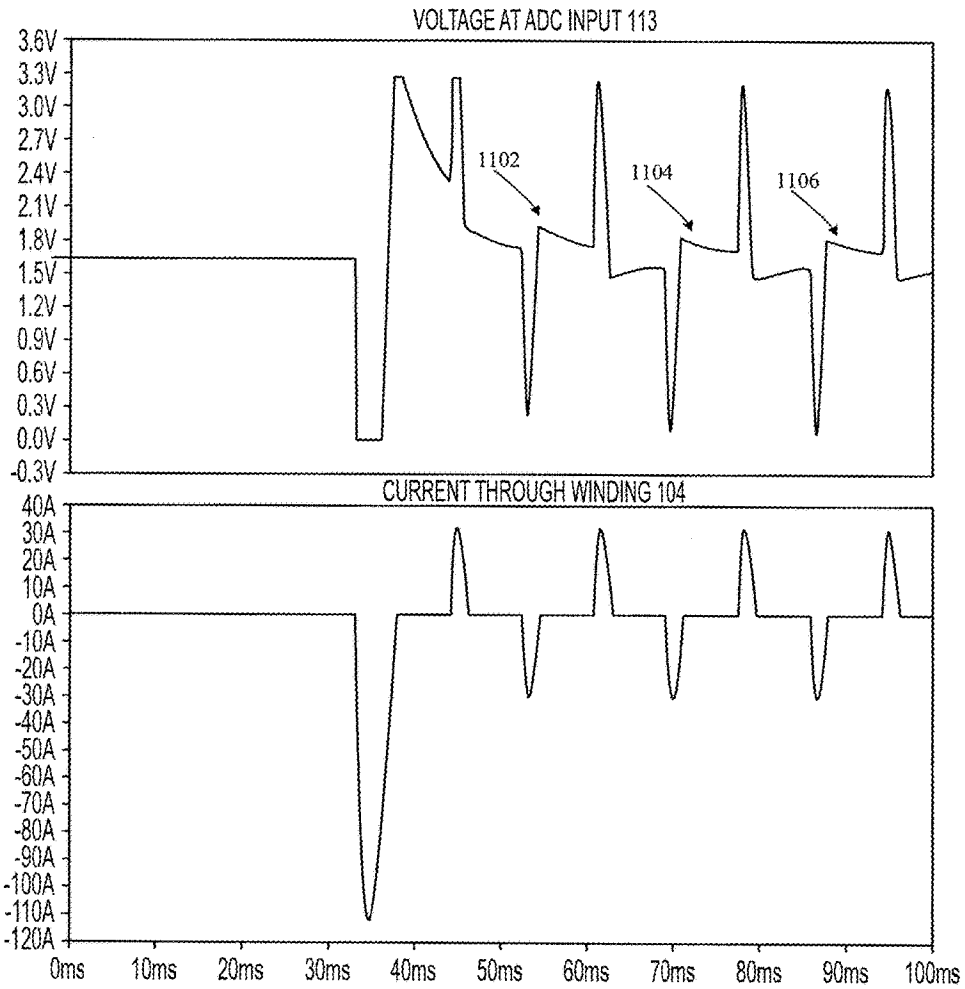
FIG. 11 is a diagram depicting examples of a current through a primary winding of the current sense transformer depicted in FIG. 8 and a corresponding voltage detected using current through the secondary winding of the current sense transformer when the current sense transformer is used in an electrical system with an electronic load.

FIGS. 9-11 depict examples of waveforms for a current provided to different types of load devices using an electrical system having a current sense transformer 102 and the AC offset circuit 108 depicted in FIG. 8.

FIG. 9 depicts examples of waveforms for a resistive load device 120 that is turned on after a 33.3 millisecond delay. The lower waveform is a current through the primary winding 104 of the current sense transformer 102 and corresponds to the load current through the load device 120. The upper waveform is the corresponding voltage received at the ADC input 113 of the processing device 112. The voltage received at the ADC input 113 of the processing device 112 is obtained using the current sense transformer 102 and is offset by a suitable AC offset circuit 108.

As depicted in FIG. 9, the voltage at the ADC input 113 has a DC component of 1.65 V that corresponds to the 1.65 V offset provided by the AC offset circuit 108. The times at which the voltage at the ADC input 113 has a value at the DC component correspond to zero-crossing points for the load current waveform (e.g., the current through winding 104).

FIG. 10 depicts examples of waveforms for a magnetic load device 120 that is turned on after a 33.3 millisecond delay. The lower waveform is a current through the primary winding 104 of the current sense transformer 102 and corresponds to the load current through the load device 120. The upper waveform is the corresponding voltage received at the ADC input 113 of the processing device 112. The voltage received at the ADC input 113 of the processing device 112 is obtained using the current sense transformer and is offset by a suitable AC offset circuit 108.

As depicted in FIG. 10, the voltage at the ADC input 113 has a DC component of 1.65 V that corresponds to the 1.65 V offset provided by the AC offset circuit 108. The times at which the voltage at the ADC input 113 has a value at the DC component correspond to zero-crossing points for the load current waveform (e.g., the current through winding 104).

FIG. 11 depicts examples of waveforms for an electronic load device 120 that is turned on after a 33.3 millisecond delay. The lower waveform is a current through the primary winding 104 of the current sense transformer 102 and corresponds to the load current through the load device 120. The upper waveform is the corresponding voltage received at the ADC input 113 of the processing device 112. The voltage received at the ADC input 113 of the processing device 112 is obtained using the current sense transformer and is offset by a suitable AC offset circuit 108. For the load current waveform depicted in FIG. 11, a current sense discontinuity in the sampled load current waveform can be ignored or filtered by an algorithm executed by the processing device 112.

As depicted in FIG. 7, the voltage at the ADC input 113 has a DC component of 1.65 V that corresponds to the 1.65 V offset provided by the AC offset circuit 108. The times at which the voltage at the ADC input 113 has a value at the DC component or within a threshold value of the DC component (e.g., the waveform portions 1102, 1104, 1106) correspond to zero-crossing points for the load current waveform (e.g., the current through winding 104).

The operational lifespan of the relay 117 can be increased by switching power to the load device 120 at a point at which a sinusoidal input voltage or current from a power source has a zero value (i.e., "a zero-crossing"). For example, a delay may occur between the time at which a driving signal is applied to an actuation circuit 118 and the time at which the relay 117 begins allowing current to flow to the load device 120. This delay constitutes that actuation duration of the relay 117. The actuation duration can be the duration of movement by an armature of the relay 117 from a first contact position, such as an open position preventing current from flowing between a power source and a load device 120, to a second contact position, such as a closed position allowing current to flow between a power source 116 and the load device 120. Configuring the timing for actuating a relay can include offsetting a point in time at which a relay is actuated from a point in time associated with a zero-crossing.

In some aspects, the relay control device 100 is used to determine an actuation duration of the relay 117. For example, a signal obtained by the processing device 112 using the current sense transformer 102 can be used to determine the difference between a first point in time at which a relay is actuated and a second point in time at which a contact of a relay is at a closed position. The duration involved in actuating the relay 117 from an open position to a closed position can vary based on various circumstances, such as the type of relay used, the temperature of the operating environment in which the relay 117 is positioned, etc. Therefore, using the relay control device 100 to determine the actuation duration may improve the operation of an electrical device or system that includes the relay 117.

Figure 12:
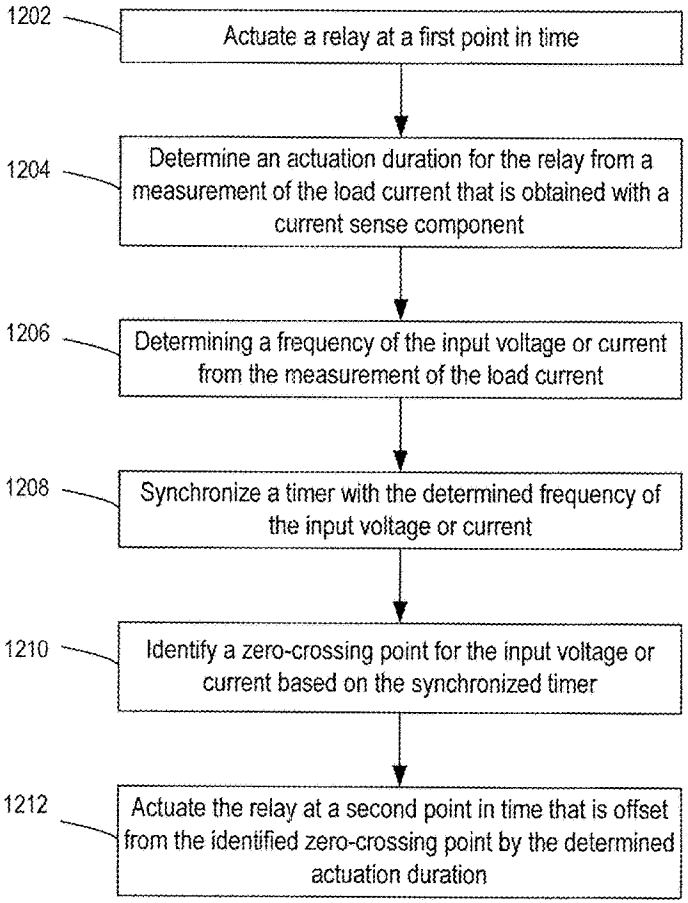
FIG. 12 is a flow chart depicting an example of a process for using a relay control device depicted in FIGS. 1 and 2 to modify the time at which a relay is actuated.

FIG. 12 is a flow chart depicting an example of a process 1200 for using a relay control device 100 to modify the time at which a relay 117 is actuated. The process is described with respect to the implementations described above with respect to FIGS. 1-11. However, other implementations are possible.

At block 1202, the process 1200 involves actuating a relay at a first point in time. Actuating the relay 117 allows a load current, which is generated from an input voltage or current to an electrical system, to flow to a load device 120 in the electrical system.

In some aspects, the processing device 112 can perform one or more operations that cause the actuation circuit 118 to actuate the relay 117. An example of these operations includes providing a driving signal to one or more components of the actuation circuit 118, such as (but not limited to) an actuation coil 402 or the transistor 406, that are used to actuate the relay 117.

In some aspects, the processing device 112 can cause the relay 117 to be actuated in a manner that is independent of data describing previous actuations of the relay 117. For example, the processing device 112 can provide a driving signal to the actuation circuit 118 at a default time period specified in a non-transitory computer-readable medium, at a random point in time selected by the processing device 112, or some other point in time that does not depend on data describing previous operations of the relay 117. In this manner, the relay 117 can be actuated without using previous actuation data.

In additional or alternative aspects, the processing device 112 can use the timer 115 to control the actuation of the relay 117 at block 1202. For example, the timer 115 may have previously been configured so that timing operations of the timer 115 approximate a prior frequency of a line voltage. The processing device 112 can use a frequency that is identified from the timer 115 to control the actuation timing of the relay 117. The use of the timer 115 to control the actuation timing is described in detail below.

At block 1204, the process 1200 involves determining an actuation duration for the relay 117 from a measurement of the load current that is obtained with a current sense component, such as (but not limited to) the current sense transformer 102. For example, current flowing through the primary winding 104 to the load device 120 (as depicted in FIG. 1) or to the relay 117 (as depicted in FIG. 2) can induce a secondary current flow through the secondary winding 106. An alternating current that flows through the secondary winding 106 can be offset by the AC offset circuit 108. The offset current waveform can be filtered by the filter circuit 110. Other examples of current sense components that can be used to implement block 1204 are described below with respect to FIGS. 14-16.

An ADC, which may be included in or communicatively coupled to the processing device 112, can sample the voltage at the ADC input 113 to obtain measurement data about the load current. For example, the processing device 112 can configure the ADC to sample the filtered waveform with a sampling frequency that is at least twice the frequency of the filtered current waveform, although the sampling frequency may be much higher than that to enhance the accuracy of an RMS algorithm that is used to determine zero-cross points of the load current. The sampled current measurement data is indicative of the load current that flows through the primary winding 104.

The processing device 112 can execute one or more algorithms for determining the actuation duration using the obtained current measurement data that is indicative of the current flow through the primary winding 104. In some aspects, the processing device 112 can determine the actuation duration from a difference between a point in time at which the processing device 112 provided a signal to the actuation circuit 118 to actuate the relay 117 and a second point in time at which current begins to flow through the primary winding 104 and (by extension) the relay 117. The processing device 112 can record the time at which the signal was provided to the actuation circuit and the time at which the current begins to flow in a non-transitory computer-readable medium. For example, the processing device 112 can store current measurement data sampled from the ADC input 113 in a data array or other suitable data structure. The processing device 112 can retrieve the data values from the computer-readable medium to determine the actuation duration. Storing the current measurement data can provide a historical record of relay actuation data, including changes in actuation times.

At block 1206, the process 1200 involves determining a frequency of the input voltage or current from the measurement of the load current. For example, the processing device 112 can obtain current measurement data as described above with respect to block 1204. The processing device 112 can store the current measurement data in a non-transitory computer-readable medium. The stored current measurement data can provide information about the waveform of the electrical current flowing through the primary winding 104 toward the load device 120. For example, the current measurement data can include a number of log entries. Each log entry can include an amplitude of the current and a time at which the current reached the amplitude.

The processing device 112 can execute one or more operations to analyze the load current waveform and thereby identify one or more zero-crossings for the load current waveform. For example, the processing device 112 can identify log entries describing current amplitudes at or near a DC component (e.g., the 1.65 V value depicted in the upper waveforms of FIGS. 6-7 and 9-11). If a log entry has a current amplitude at or near a DC component, this current amplitude can indicate a zero-crossing, since the voltage received at the AC input 113 may be offset from zero by the DC component using the AC offset circuit 108. The processing device 112 can identify the associated times for those log entries. The processing device can determine a frequency of the load current waveform based on the zero-crossing identified from the time entries.

In some aspects, the processing device 112 can execute an RMS algorithm or other suitable algorithm that uses the current measurement data to identify characteristics of the load current waveform (e.g., the zero-crossing points). The RMS algorithm can calculate or otherwise determine the load current. In additional or alternative aspects, the processing device 112 can execute a waveform analysis algorithm that uses the current measurement data to identify characteristics of the load current waveform (e.g., the zero-crossing points).

At block 1208, the process 1200 involves synchronizing a timer 115 with the determined frequency of the input voltage or current. For example, the processing device 112 can analyze the load current waveform and thereby use the load current waveform along with the reference clock 122 to synchronize the timer 115 with a frequency that is used by the power source 116 when providing an input voltage or current. Examples of this synchronization are described in detail above with respect to FIGS. 1 and 2.

The processing device 112 can configure the timer 115 such that the timer 115 indicates when the next zero-crossing point will be for the load current waveform when the relay 117 is in an "OFF" state. For example, the processing device 112 may store a number of clock ticks from the reference clock 122, where the number of clock ticks corresponds to the time of a period or half-period for the input voltage or current (i.e., a subsequent point in the waveform corresponding to zero-crossing or DC value of the waveform). The timer 115 can iteratively count the number of clock ticks received from the reference clock 122 when the relay 117 is in an "OFF" state. The processing device 112 can reset the count on the timer 115 after the count reaches the stored number of clock ticks. In this manner, the timer 115 is reset to zero at the zero-crossing point (or a point corresponding to a DC value) of the input voltage or current waveform.

Furthermore, at a given point in time, the difference between a current number of counted clock ticks and the stored number of clock ticks can indicate a time until the next zero-cross point of the waveform. For example, the processing device 112 may have previously identified 166,666 clock ticks as indicating a time between zero-crossing points. The processing device can also determine that a current count at the timer 115 is 100,000 clock ticks. The processing device can therefore determine that a zero-crossing point will occur after the next 66,666 clock ticks.

In some aspects, the processing device 112 can compensate for operating temperature variations that may affect the operating frequency of the reference clock 122 by storing different clock tick numbers associated with different operating temperatures of the reference clock 122. For example, at block 1208, the processing device 112 can read a temperature measurement at the input 126 that is provided by the temperature sensor 125. The processing device 112 can store a record in a non-transitory computer-readable medium that associates the temperature measurement with a stored number of clock ticks indicating a time between zero-crossing points. Over time, the processing device 112 can store multiple records that associate different temperature measurements with respective numbers of clock ticks indicating a time between zero-crossing points. In this manner, even if the time between zero-crossing points remains the same for different operating temperatures of the reference clock 122, the processing device 112 can use a stored number of clock ticks that is appropriate for a current operating temperature of the reference clock 122 when measuring the time until a subsequent zero-crossing point.

At block 1210, the process 1200 involves identifying a zero-crossing point for the input voltage or current based on the synchronized timer 115. For example, the processing device 112 may receive a command to actuate the relay 117 or otherwise determine that the relay 117 should be actuated. In response to receiving the command, the processing device 112 can reference the synchronized timer 115 to identify the next zero-crossing point for the input voltage or current waveform. For example, the processing device 112 can determine the difference between a stored number of clock ticks, which indicates the time between zero-crossing points, and a counted number of clock ticks at the timer 115, which indicates the time elapsed since the most recent zero-crossing point. The difference between the stored number and the counted number can indicate the time until the next zero-crossing point. For example, the processing device 112 can use the operating frequency of the reference clock 122 to convert numbers of ticks to time durations.

In some aspects, identifying a zero-crossing point for the input voltage or current based on the synchronized timer 115 involves compensating for operating temperature variations that may affect the operating frequency of the reference clock. For example, as described above with respect to block 1208, multiple numbers of clock ticks corresponding to different operating temperatures of the reference clock can be stored in a non-transitory computer-readable medium. At block 1210, the processing device 112 can determine the current operating temperature of the reference clock 122 using a temperature measurement from the temperature sensor 125 that is received at the input 126. The processing device 112 can select a stored number of clock ticks that is closest in value to the temperature measurement. The processing device 112 can use a difference between the selected number of clock ticks and a counted number of clock ticks to determine a time until the next zero-crossing point.

At block 1212, the process 1200 involves actuating the relay 117 at a second point in time that is offset from the identified zero-crossing point by the determined actuation duration. For example, the processing device 112 can be configured to actuate the relay 117 such that the relay 117 begins allowing current to flow through the relay 117 at point in time coinciding with a zero-crossing point of the load current or an input voltage. In response to determining that the relay 117 should be actuated, the processing device 112 can retrieve the actuation duration from a memory device. The processing device 112 can identify an appropriate time for actuating the relay 117 that is offset by the zero-crossing time by the actuation duration. In some aspects, the processing device 112 can provide a driving signal to the actuation circuit 118 far enough in advance of the zero-crossing that the relay 117 reaches a closed position and begins allowing current flow during the zero-crossing point.

Actuating the relay can include one or more of opening the relay 117, closing the relay 117, or any other operation changing the state of the relay 117. In a non-limiting and simplified example provided for illustrative purposes, for an actuation duration of T milliseconds, actuating the relay 117 at a second point in time that is offset from the identified zero-crossing point by the actuation duration can involve causing a driving signal to be applied to an actuation circuit 118 at a point in time that is T milliseconds before a subsequent zero-crossing point such that the relay 117 starts allowing current flow to the load device 120 at the zero-crossing point. In another non-limiting and simplified example, for an actuation duration of T milliseconds, actuating the relay 117 at the second point in time that is offset from the identified zero-crossing point can involve causing a driving signal to be applied to an actuation circuit 118 at a point in time that is T milliseconds before a subsequent zero-crossing point such that the relay 117 stops allowing current flow to the load device 120 at the zero-crossing point.

In some aspects, one or more operations described above with respect to the process 1200 can be performed based on the relay 117 being in an "OFF" state for a prolonged period of time. For example, in a first iteration of the process 1200, the timer 115 can be synchronized with the frequency of an input voltage or current waveform, as described above with respect to block 1208. After the first iteration, the relay 117 may be set to an "OFF" and remain in the "OFF" state for a prolonged period of time, during which the current sense transformer 102 is inactive and line frequency resynchronization is not possible. In a second, subsequent iteration of the process 1200, the timer 115 can be used by the processing device 112 to select an actuation time for the relay 117 at block 1202 of the process 1200. Using the previously synchronized timer 115 can minimize or otherwise reduce errors resulting from the relay 117 reaching a closed state at a time other than a zero-crossing point.

For example, data describing a threshold amount of time (e.g., 12 hours or more) may be stored in a non-transitory computer-readable medium that is accessible to the processing device 112. Data describing the most recent actuation time for the relay 117 can also be stored in the computer-readable medium. In response to determining that the relay 117 should be actuated, the processing device 112 can access and compare the data describing the threshold amount of time and the data describing the most recent actuation time for the relay 117. If processing device 112 determines that the most recent actuation time for the relay 117 is outside the threshold amount of time, the processing device 112 can perform one or more operations described above to synchronize a timer associated with the processing device 112 with a frequency of the load current waveform.

In some aspects, the processing device 112 can monitor the load current and update the synchronization of the timer 115 to account for variations in the frequency of the load current waveform to control the actuation of the relay 117. For example, the processing device 112 may perform a waveform analysis algorithm for the load current waveform at regular intervals while the load current is provided to the load device 120. Each time the processing device 112 performs the waveform analysis, the processing device 112 can determine a frequency of the input voltage or current waveform. The processing device 112 can compare the determined frequency to a previously determined frequency of the input voltage or current (e.g., a frequency determined from a previous execution of the waveform analysis algorithm). If the currently determined frequency differs from the previously determined frequency, the processing device 112 can configure the timer 115 such that the timer 115 is synchronized with the currently determined frequency. If the currently determined frequency is the same as the previously determined frequency, the processing device 112 can continue using the current configuration for the timer 115.

In additional or alternative aspects, relay control device 100 can include a or be communicatively coupled to a temperature measurement device, such as the temperature sensor 130. A relay actuation time may depend on the ambient temperature in the vicinity of the relay 117. The processing device 112 can determine the ambient temperature using the temperature sensor 130. The processing device 112 can record fluctuations in the actuation duration of the relay 117 and the corresponding ambient temperature measurements. The processing device 112 can use this data to generate a look-up table or other suitable data structure over time.

For example, the temperature sensor 130 can be used to determine a temperature of the actuation coil of the relay 117. In some aspects, the temperature sensor 130 can directly measure the temperature of one or more components of the actuation circuit 118 (e.g., an actuation coil). In other aspects, the temperature sensor 130 can measure an ambient temperature at a location sufficiently close to an actuation coil so as to provide an accurate determination of the temperature of the actuation coil. In some aspects, a temperature sensor 130 external to the relay 117 can be coupled to a probe disposed within the relay control device 100 and communicatively coupled to the processing device 112. In other aspects, a temperature sensor 130 can be integrated with the relay control device 100. Non-limiting examples of the temperature sensor 130 include a thermistor, a diode, a temperature probe, an integrated circuit, etc.

Figure 13:
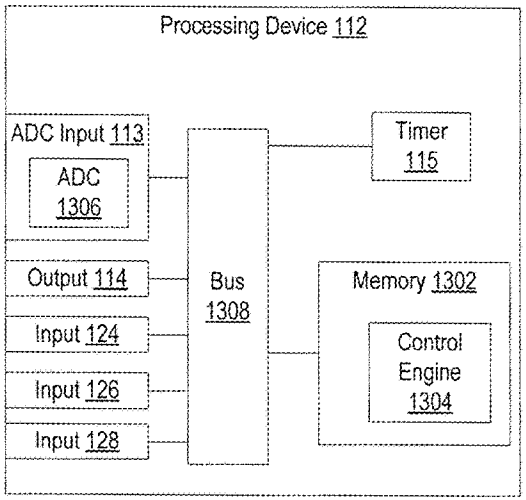
FIG. 13 is a block diagram depicting an example of a processing device from the relay control device depicted in FIGS. 1 and 2.

FIG. 13 is a block diagram depicting an example of the processing device 112.

Examples of processing device 112 include a microprocessor, an application-specific integrated circuit ("ASIC"), a field-programmable gate array ("FPGA"), or other suitable processor. The processing device 112 may include one processor or any number of processors.

The processing device 112 can execute code, such as a control engine 1304, stored on a computer-readable medium, as a memory 1302, to control operations of the relay 117. The memory 1302 can be integrated with the processing device 112 (as depicted in FIG. 13) or can be a separate device that is communicatively coupled to the processing device 112 via a suitable communicative coupling (e.g., a printed circuit board).

The memory 1302 may be any non-transitory computer-readable medium capable of tangibly embodying code. Examples of a non-transitory computer-readable medium may include (but are not limited to) an electronic, optical, magnetic, or other storage device capable of providing a processor with computer-readable instructions.

An ADC input 113 of the processing device 112 can include or be communicatively coupled to an ADC 1306. The ADC 1306 can sample a voltage present at the ADC input 113 (e.g., a voltage waveform generated using the current sense transformer 102).

In some aspects, the processing device 112 can include a bus 1308 that communicatively couples components of the processing device 112. Other implementations, however, are possible. For example, the ADC input 113, the ADC 1306, the output 114, the timer 115, and the memory 1302 can be communicatively coupled in any suitable manner. In one example, the components depicted in FIG. 13 may be installed on a printed circuit board and communicatively coupled via the wire traces of the printed circuit board. In another example, the ADC input 113, the ADC 1306, the output 114, the timer 115, and the memory 1302 can be integrated in a single chip of a microcontroller.

Figure 15:
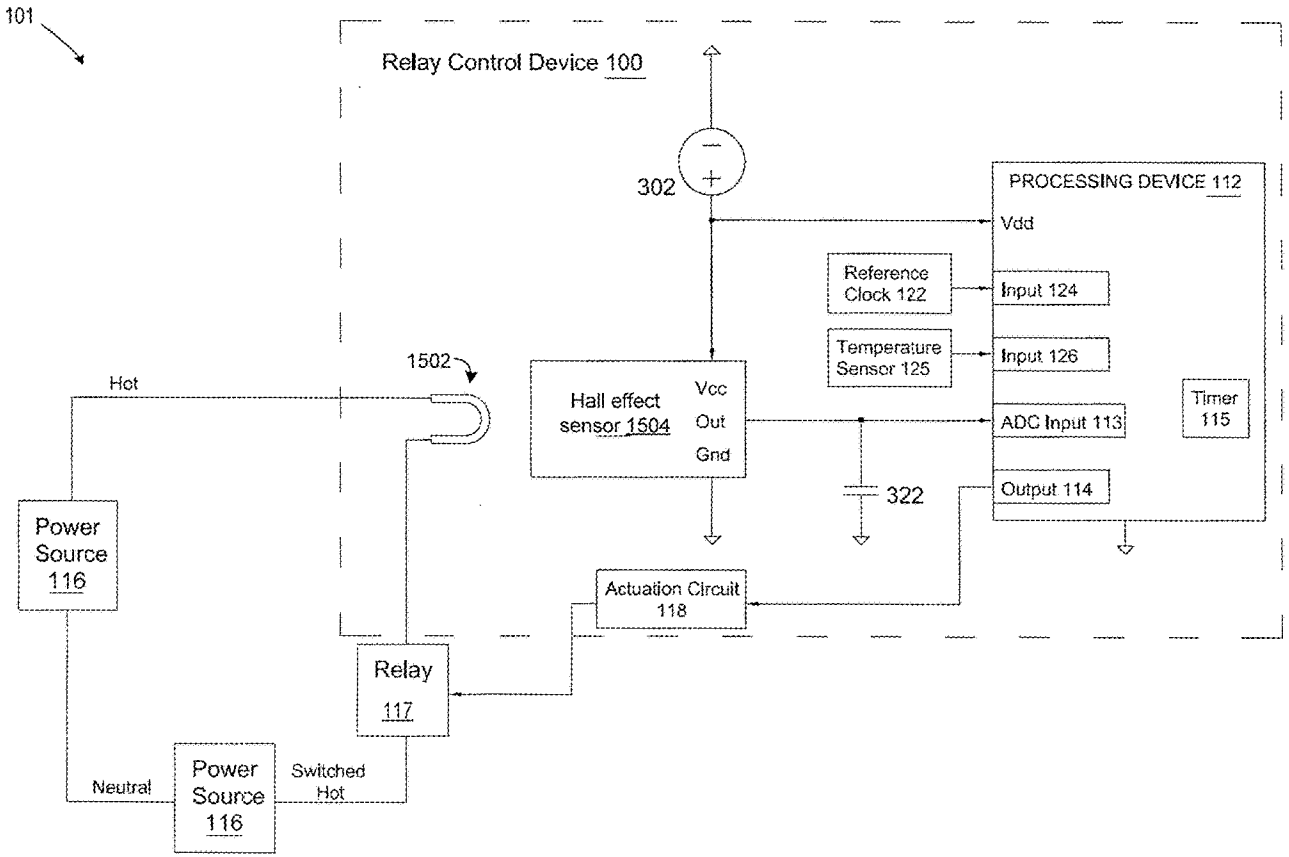
FIG. 15 is a block diagram illustrating an example of an electrical system in which a relay control device includes a Hall effect sensor that is used to obtain measurements of a load current for controlling actuation timing of a relay.
Figure 16:
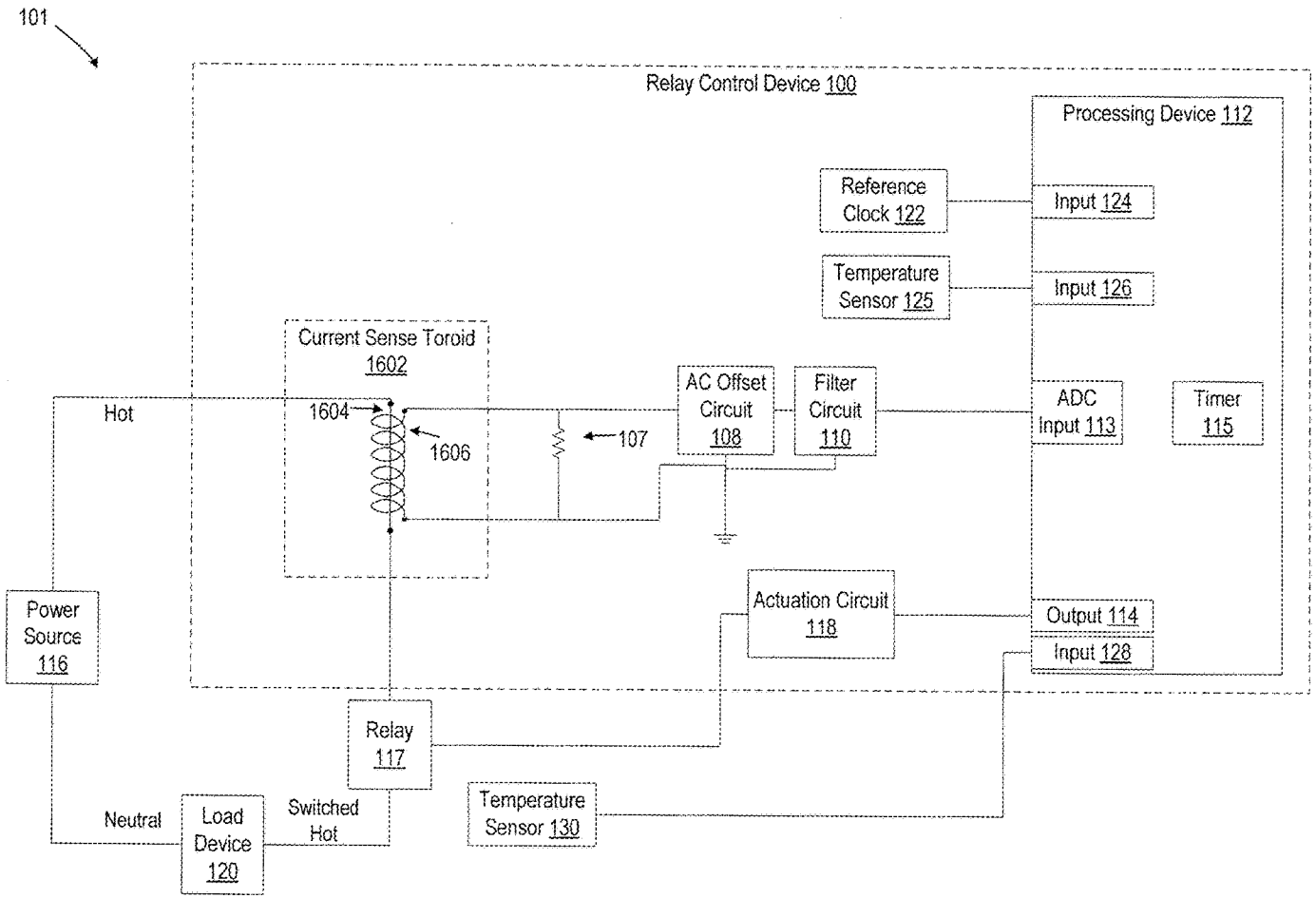
FIG. 16 is a block diagram illustrating an example of an electrical system in which a relay control device includes a current sense toroid that is used to obtain measurements of a load current for controlling actuation timing of a relay.

Although the relay control device 100 has been described above as using a current sense transformer, other implementations are possible. For example, FIGS. 14-16 depict alternative examples of a relay control device 100 in which the current sense transformer 102 is replaced with another current-sensing component.

Figure 14:
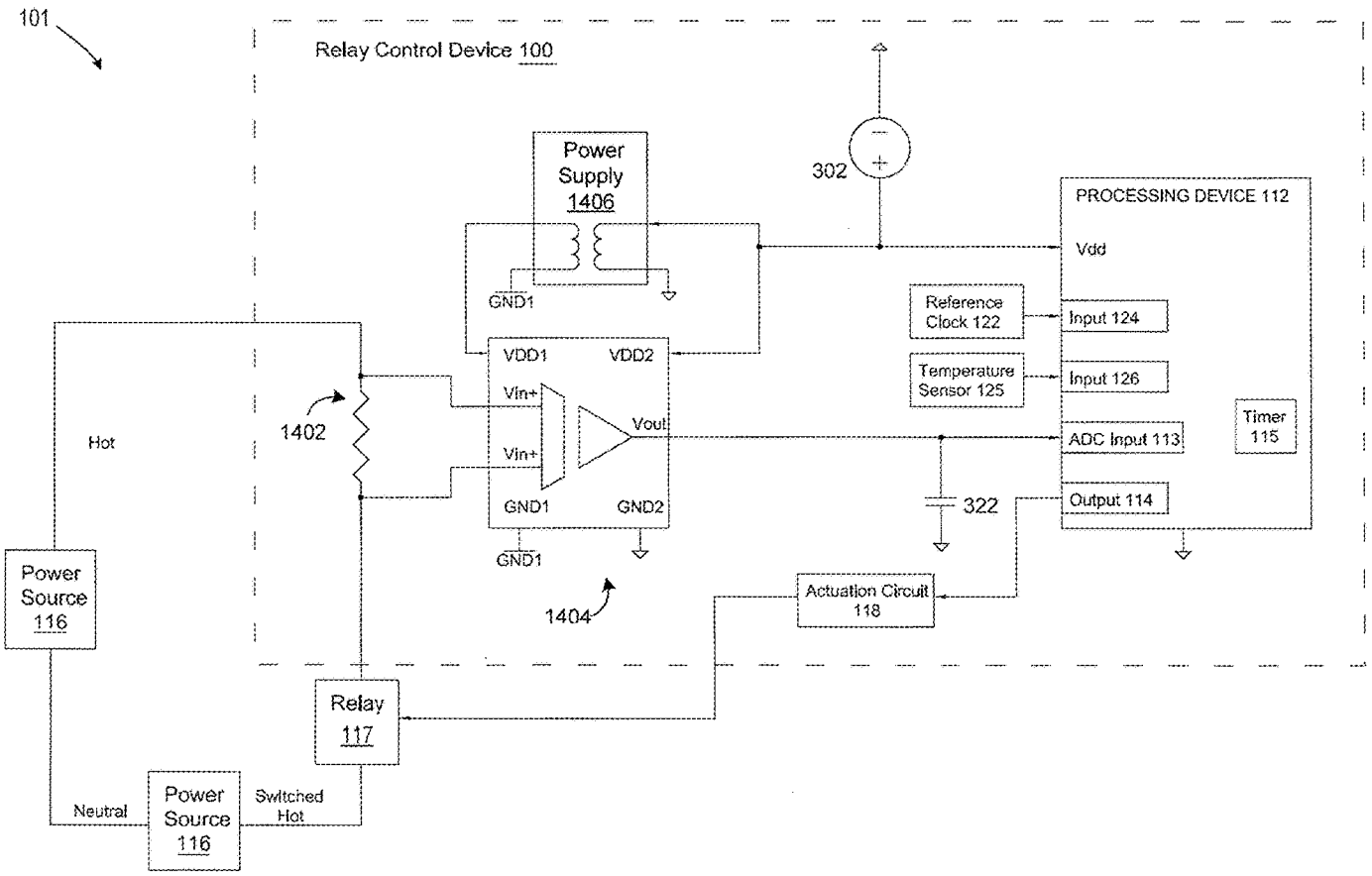
FIG. 14 is a block diagram illustrating an example of an electrical system in which a relay control device includes a current sense resistor that is used to obtain measurements of a load current for controlling actuation timing of a relay.

FIG. 14 is a block diagram illustrating an example of an electrical system 101 in which the relay control device 100 includes a current sense resistor 1402 that is used to obtain measurements of a load current for controlling actuation timing of the relay 117.

The current sense resistor 1402 is electrically connected to the inputs of a differential isolation amplifier 1404. A non-limiting example of a differential isolation amplifier 1404 that is depicted in FIG. 14 is a Texas Instruments AMC 1200, in which the terminals of the current sense resistor are respectively connected to the inputs labeled "Vin" of the differential isolation amplifier 1404. The differential isolation amplifier 1404 is electrically coupled to an isolation power supply 1406.

The current sense resistor 1402 is electrically connected in series with the relay 117 such that the load current flows through the current sense resistor 1402. A voltage drop across the current sense resistor 1402 is detected using the differential isolation amplifier 1404. An output voltage is provided from the Vout terminal of the differential isolation amplifier 1404 to the ADC input 113 of the processing device 112. The output voltage from differential amplifier is proportional in amplitude to the amplitude of the load current through the current sense resistor 1402. The voltage at the ADC input 113 is sampled and used by the processing device 112 in the same manner as described above with respect to FIGS. 1-13.

The implementation depicted in FIG. 14 is provided for illustrative purposes. Other implementations involving the use of a current sense resistor as a current sensing component are possible.

FIG. 15 is a block diagram illustrating an example of an electrical system 101 in which the relay control device 100 includes a Hall effect sensor 1504 that is used to obtain measurements of a load current for controlling actuation timing of the relay 117. A loop trace 1502 is electrically connected in series with the relay 117 such that the load current flows through the loop trace 1502. The flow of load current through the loop trace 1502 causes a magnetic field to be generated. The Hall effect sensor 1504 can detect the generated magnetic field and output a signal to the ADC input 113. The outputted signal, which can be an AC voltage proportional to current flow through loop trace 1502, is indicative of the load current flowing to the relay 117. The voltage at the ADC input 113 is sampled and used by the processing device 112 in the same manner as described above with respect to FIGS. 1-13.

In some aspects, the Hall effect sensor 1502 depicted in FIG. 15 can be implemented as an integrated circuit that can automatically offset a reference voltage to 1.65 V. In these aspects, the AC offset circuit 108 may be omitted from the relay control device 100. In additional or alternative aspects, an output from the Hall effect sensor 1502 can be connected directly to ADC input 113 of the processing device 112. For example, an integrated circuit used to implement the Hall effect sensor 1502 can include a protection diode and a filter capacitor, which can allow the output terminal (labeled "Out") to be directly connected to the ADC input 113 (e.g., without an intervening AC offset circuit 108 and without an intervening filter circuit 110).

The implementation depicted in FIG. 15 is provided for illustrative purposes. Other implementations involving the use of a Hall effect sensor as a current sensing component are possible.

FIG. 16 is a block diagram illustrating an example of an electrical system 101 in which the relay control device 100 includes a current sense toroid 1602 that is used to obtain measurements of a load current for controlling actuation timing of the relay 117. The current sense toroid 1602 includes a coil 1606. A load current flowing to the relay 117 via a primary conductor 1604 induces a secondary current in the coil 1606. The secondary current that is induced in the coil 1606 can be used in the same manner as the secondary current induced in the secondary winding 106 of the current sense transformer 102, as described above with respect to FIGS. 1-13.

The implementation depicted in FIG. 16 is provided for illustrative purposes. Other implementations involving the use of a current sense toroid as a current sensing component are possible.

The implementations depicted in FIGS. 1-16 are presented for illustrative purposes only. In some embodiments, additional components may be included in the schematics described above for purposes of reliability, safety, or other enhancements to the operation of the electrical system 101.

The foregoing description, including illustrated examples, has been presented only for the purpose of illustration and description and is not intended to be exhaustive or to limit the invention to the precise forms disclosed. Numerous modifications, adaptations, and uses thereof will be apparent to those skilled in the art without departing from the scope of this invention. The illustrative examples described above are given to introduce the reader to the general subject matter discussed here and are not intended to limit the scope of the disclosed concepts. The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the disclosure.

The invention claimed is:

1. A method comprising:

actuating a relay at a first point in time so that a first load current generated from an input voltage or current to an electrical system flows to a load device in the electrical system;

determining an actuation duration for the relay from a measurement of the first load current that is obtained with a current sense transformer, wherein the actuation duration comprises a difference between a time at which an actuation signal is provided for the relay and a time at which the relay begins allowing current flow through the relay;

determining a frequency of the input voltage or current from the measurement of the first load current;

synchronizing a timer of a processing device with the determined frequency of the input voltage or current, wherein synchronizing the timer of the processing device with the determined frequency of the input voltage or current comprises:

identifying a waveform of the input voltage or current from load current measurements that are received while the relay is in an on state;

determining a number of clock ticks received from a reference clock between two zero-crossing points of the identified waveform; and while the relay is in an off state:

counting clock ticks received from the reference clock, selecting a stored clock tick count corresponding to the determined number of clock ticks, and resetting the timer in response to a counted number of clock ticks being greater than or equal to the selected clock tick count;

identifying a zero-crossing point for a second load current based on the synchronized timer; and actuating the relay at a second point in time, wherein the second point in time is offset from the identified zero-crossing point by the determined actuation duration.

2. The method of claim 1, wherein the method further comprises:

prior to actuating the relay at the first point in time, synchronizing the timer with a previous frequency determined from a previous measurement of a previous load current flowing to the load device; and determining that the previous frequency differs from the frequency that is determined after actuating the relay at the first point in time, wherein the timer is synchronized with the determined frequency based on the determined frequency differing from the previous frequency.

3. The method of claim 1, wherein the determined number of clock ticks is a first number of clock ticks, wherein synchronizing the timer of the processing device with the determined frequency of the input voltage or current further comprises:

identifying a first operating temperature of the reference clock during a first time period in which the first number of clock ticks was received;

determining a second number of clock ticks received from the reference clock between two additional zero-crossing points of the identified waveform;

identifying a second operating temperature of the reference clock during a second time period in which the second number of clock ticks was received; and while the relay is in the off state:

identifying an operating temperature of the reference clock during the off state, performing at least one of:

selecting, as the selected clock tick count, a first stored clock tick count corresponding to the first number of clock ticks based on the identified operating temperature being closer to the first operating temperature than the second operating temperature, and selecting, as the selected clock tick count, a second stored clock tick count corresponding to the second number of clock ticks based on the identified operating temperature being closer to the second operating temperature than the first operating temperature.

4. The method of claim 1, wherein the method further comprises selecting the first point in time independently of data describing actuations of the relay prior to the first point in time.

5. The method of claim 4, wherein the first point in time is selected at a random time or at a default time stored in a non-transitory computer-readable medium accessible to the processing device.

6. The method of claim 1, wherein the method further comprises:

measuring a temperature at or near the relay;

storing data describing the temperature and the actuation duration in a non-transitory computer-readable medium; and subsequent to actuating the relay at the second point in time:

determining that a measurement of the temperature at or near the relay is sufficiently similar to the stored temperature, selecting the stored actuation duration based on the measurement of the temperature being sufficiently similar to the stored temperature, and actuating the relay at a third point in time so that a third load current flows to the load device, wherein the third point in time is offset from the identified zero-crossing point by the selected actuation duration.

7. The method of claim 1, wherein the frequency of the input voltage or current is determined by the processing device executing an algorithm in which the measurement of the first load current is the only electrical measurement used to determine the frequency.

8. An electrical system comprising:

a current sense transformer comprising a winding that is electrically connectable between a source of a load current and a load device;

a relay control device comprising:

a processing device, wherein the processing device is electrically connected to the current sense transformer and electrically connectable to a relay for controlling a flow of the load current to the load device, a reference clock that is communicatively coupled to the processing device; and a timer included in or communicatively coupled to the processing device, wherein the processing device is configured for:

causing the relay to be actuated at a first point in time so that a first load current generated from an input voltage or current provided by the source flows to the load device, determining an actuation duration for the relay from a measurement of the first load current that is obtained with the current sense transformer, wherein the actuation duration comprises a difference between a time at which an actuation signal is provided for the relay and a time at which the relay begins allowing current flow through the relay;

determining a frequency of the input voltage or current from the measurement of the first load current, synchronizing the timer with the determined frequency of the input voltage or current, wherein synchronizing the timer of the processing device with the determined frequency of the input voltage or current comprises:

identifying a waveform of the input voltage or current from load current measurements that are received while the relay is in an on state;

determining a number of clock ticks received from the reference clock between two zero-crossing points of the identified waveform; and while the relay is in an off state:

counting clock ticks received from the reference clock, selecting a stored clock tick count corresponding to the determined number of clock ticks, and resetting the timer in response to a counted number of clock ticks being greater than or equal to the selected clock tick count, identifying a zero-crossing point for a second load current based on the synchronized timer, and causing the relay to be actuated at a second point in time, wherein the second point in time is offset from the identified zero-crossing point by the determined actuation duration.

9. The electrical system of claim 8, wherein the processing device is further configured for:

prior to actuating the relay at the first point in time, synchronizing the timer with a previous frequency determined from a previous measurement of a previous load current flowing to the load device; and determining that the previous frequency differs from the frequency that is determined after actuating the relay at the first point in time, wherein the timer is synchronized with the determined frequency based on the determined frequency differing from the previous frequency.

10. The electrical system of claim 8, wherein the determined number of clock ticks is a first number of clock ticks, wherein the operations for synchronizing the timer further comprise:

identifying a first operating temperature of the reference clock during a first time period in which the first number of clock ticks was received;

determining a second number of clock ticks received from the reference clock between two additional zero-crossing points of the identified waveform;

identifying a second operating temperature of the reference clock during a second time period in which the second number of clock ticks was received; and while the relay is in an off state:

identifying an operating temperature of the reference clock during the off state, performing at least one of:

selecting, as the selected clock tick count, a first stored clock tick count corresponding to the first number of clock ticks based on the identified operating temperature being closer to the first operating temperature than the second operating temperature, and selecting, as the selected clock tick count, a second stored clock tick count corresponding to the second number of clock ticks based on the identified operating temperature being closer to the second operating temperature than the first operating temperature.

11. The electrical system of claim 8, wherein the relay control device further comprises an AC offset circuit in an electrical path from the current sense transformer to the processing device, wherein the AC offset circuit is configured for:

receiving a secondary current that is induced in a secondary winding of the current sense transformer by the first load current flowing through a primary winding of the current sense transformer, modifying, by the AC offset circuit, the secondary current by shifting a DC component of the secondary current so that negative voltages are eliminated from a waveform of the secondary current, and providing the modified secondary current to an input of the processing device;

wherein the processing device is further configured for obtaining the measurement of the first load current by sampling the modified secondary current at the input.

12. The electrical system of claim 8, further comprising the relay and the load device, wherein the processing device is electrically connected to the relay and the winding of the current sense transformer is electrically connected between the source and the load device.

13. The electrical system of claim 8, wherein the current sense transformer is included in the relay control device.

14. The electrical system of claim 8, wherein the current sense transformer is included in a relay and measurement sub-system that is communicatively coupled to the relay control device, wherein the relay and measurement sub-system comprises the relay.

15. A relay control device comprising:

a processing device that is communicatively connectable to a current sense component and electrically connectable to a relay for controlling a flow of a load current to a load device, and a timer included in or communicatively coupled to the processing device, wherein the processing device is configured for:

causing the relay to be actuated at a first point in time so that a first load current generated from an input voltage or current provided by a source flows to the load device, determining an actuation duration for the relay from a measurement of the first load current that is obtained with the current sense component, wherein the actuation duration comprises a difference between a time at which an actuation signal is provided for the relay and a time at which the relay begins allowing current flow through the relay;

storing, in a non-transitory computer-readable medium, data describing the actuation duration and a temperature at or near the relay;

determining a frequency of the input voltage or current from the measurement of the first load current, synchronizing the timer with the determined frequency of the input voltage or current, identifying a zero-crossing point for a second load current based on the synchronized timer, causing the relay to be actuated at a second point in time, wherein the second point in time is offset from the identified zero-crossing point by the determined actuation duration and subsequent to actuating the relay at the second point in time:

determining that a measurement of the temperature at or near the relay is sufficiently similar to the stored temperature, selecting the stored actuation duration based on the measurement of the temperature being sufficiently similar to the stored temperature, and actuating the relay at a third point in time so that a third load current flows to the load device, wherein the third point in time is offset from the identified zero-crossing point by the selected actuation duration.

16. The relay control device of claim 15, wherein the current sense component comprises a current sense transformer.

17. The relay control device of claim 15, wherein the current sense component comprises a current sense resistor electrically connected in series with the relay.

18. The relay control device of claim 17, wherein the relay control device further comprises the current sense resistor and a differential isolation amplifier, wherein inputs of the differential isolation amplifier are electrically connected to respective terminals of the current sense resistor and an output of the differential isolation amplifier is electrically connected to an input of the processing device.

19. The relay control device of claim 15, wherein the current sense component comprises a Hall effect sensor electrically connected to an input of the processing device.

20. The relay control device of claim 15, wherein the current sense component comprises a current sense toroid having a coil that is electrically connected to an input of the processing device.

* * * * *